US012486614B1

(12) United States Patent
Zheng et al.

(10) Patent No.: US 12,486,614 B1
(45) Date of Patent: Dec. 2, 2025

(54) MAGNETIC-RESPONSIVE COMPOSITIONS FOR ROOFING MATERIALS

(71) Applicant: BMIC LLC, Dallas, TX (US)

(72) Inventors: Yan Zheng, Parsippany, NJ (US); Joshua Tingley, Morris Plains, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/907,164

(22) Filed: Oct. 4, 2024

Related U.S. Application Data

(60) Provisional application No. 63/588,414, filed on Oct. 6, 2023.

(51) Int. Cl.

| | |
|---|---|
| ***D06N 5/00*** | (2006.01) |
| ***E04D 1/20*** | (2006.01) |
| ***E04D 1/26*** | (2006.01) |
| ***E04D 5/12*** | (2006.01) |
| ***E04F 13/08*** | (2006.01) |
| ***E04F 15/02*** | (2006.01) |
| *E04D 1/00* | (2006.01) |

(52) U.S. Cl.
CPC ..... *D06N 5/00* (2013.01); *E04D 1/20* (2013.01); *E04D 1/26* (2013.01); *E04D 5/12* (2013.01); *E04F 13/08* (2013.01); *E04F 15/02* (2013.01); *E04D 2001/005* (2013.01)

(58) Field of Classification Search
CPC ... D06N 5/00; E04D 5/12; B05D 1/28; B05D 1/40; B05D 3/20; B05D 3/203; B05D 3/207
See application file for complete search history.

(56) References Cited

U.S. PATENT DOCUMENTS

| | | | | |
|---|---|---|---|---|
| 5,851,338 | A | 12/1998 | Pushaw | |
| 5,932,134 | A | 8/1999 | Christ et al. | |
| 5,955,188 | A | 9/1999 | Pushaw | |
| 6,001,272 | A | 12/1999 | Ikuma et al. | |
| 6,086,791 | A * | 7/2000 | Miller | H01B 1/24 252/511 |
| 7,348,374 | B2 | 3/2008 | Martinazzo | |
| 7,838,108 | B2 | 11/2010 | Thiagarajan et al. | |
| 8,484,918 | B2 | 7/2013 | Merkel | |
| 8,486,522 | B2 | 7/2013 | Jokisch et al. | |
| 8,613,881 | B2 | 12/2013 | Soong | |
| 8,753,473 | B2 | 6/2014 | Merkel | |
| 9,593,224 | B2 | 3/2017 | Liu et al. | |
| 9,725,907 | B2 | 8/2017 | Harrington, Jr. et al. | |
| 9,944,793 | B2 | 4/2018 | Eling et al. | |
| 10,391,676 | B2 | 8/2019 | Tamai et al. | |
| 10,834,854 | B2 | 11/2020 | Zhang et al. | |
| 11,565,970 | B1 | 1/2023 | Shiao | |

(Continued)

*Primary Examiner* — Nathan H Empie
(74) *Attorney, Agent, or Firm* — GREENBERG TRAURIG, LLP

(57) ABSTRACT

Magnetic-responsive compositions for roofing materials are provided. A composition comprises a polymer and a magnetic-responsive additive. The magnetic-responsive additive, when subjected to a magnetic field, is aligned in a horizontal direction sufficient to increase a reflectivity of the composition upon curing to form a roofing material. A kit comprising a composition and a roller device is provided. The roller device comprising a roller, wherein the roller contains a magnetic array. Related systems and related methods are also provided.

10 Claims, 6 Drawing Sheets

(56) References Cited

U.S. PATENT DOCUMENTS

| | | | | |
|---|---|---|---|---|
| 2002/0112665 | A1* | 8/2002 | Huykman | B05C 19/04 118/308 |
| 2005/0123743 | A1 | 6/2005 | Martinazzo | |
| 2008/0187739 | A1 | 8/2008 | Baker et al. | |
| 2008/0261471 | A1 | 10/2008 | Chen et al. | |
| 2008/0265457 | A1 | 10/2008 | McLeod et al. | |
| 2009/0029147 | A1 | 1/2009 | Tang et al. | |
| 2009/0047502 | A1 | 2/2009 | Folaron et al. | |
| 2009/0148665 | A1 | 6/2009 | Thiagarajan et al. | |
| 2010/0089002 | A1 | 4/2010 | Merkel | |
| 2012/0092105 | A1 | 4/2012 | Weinberg et al. | |
| 2013/0295338 | A1 | 11/2013 | Keating et al. | |
| 2014/0124977 | A1 | 5/2014 | Merkel et al. | |
| 2017/0326823 | A1 | 11/2017 | Kushalappa et al. | |
| 2018/0187419 | A1 | 7/2018 | Lai et al. | |
| 2019/0023043 | A1* | 1/2019 | Raksha | B05D 5/06 |
| 2019/0153722 | A1 | 5/2019 | Schmetzer et al. | |
| 2019/0300449 | A1* | 10/2019 | Panzarella | E04D 7/00 |
| 2021/0276920 | A1 | 9/2021 | Kondratowicz et al. | |
| 2021/0292491 | A1 | 9/2021 | Ouchiyama et al. | |
| 2022/0049503 | A1* | 2/2022 | Leblanc | E04F 13/18 |

* cited by examiner

300

MAGNETIC-RESPONSIVE COMPOSITIONS FOR ROOFING MATERIALS

CROSS-REFERENCE TO RELATED APPLICATIONS

The present application claims priority to and benefit of U.S. provisional patent application No. 63/588,414, filed Oct. 6, 2023, and entitled "MAGNETIC-RESPONSIVE COMPOSITIONS FOR ROOFING MATERIALS," the contents of which are incorporated herein in their entirety for all purposes.

FIELD

This disclosure generally relates to magnetic-responsive roofing compositions for roofing materials, related systems, and related methods.

BACKGROUND

Roofing materials are exposed to solar radiation for extended periods. The solar radiation causes the roofing materials to increase in temperature and overtime reduces performance of the roofing materials.

SUMMARY

Some embodiments relate to a kit. In some embodiments, the kit comprises a container. In some embodiments, the container comprises a composition. In some embodiments, the composition comprises a polymer. In some embodiments, the polymer comprises at least one of a polysiloxane, a silyl-terminated polymer, or any combination thereof. In some embodiments, the composition comprises 1% to 20% by weight of a magnetic-responsive additive based on a total weight of the composition. In some embodiments, the kit comprises a roller device. In some embodiments, the roller device comprises a roller. In some embodiments, the roller contains a magnetic array. In some embodiments, when the composition is spread by the roller device on a roofing substrate, the magnetic array is configured to apply a directional magnetic field to the magnetic-responsive additive present in the composition.

In some embodiments, the magnetic-responsive additive has a lateral size of 1 μm to 1000 μm.

In some embodiments, the magnetic-responsive additive has a form of at least one of flakes, platelets, sheets, tubes, ribbons, rods, tubes, whiskers, fibers, spheres, cubes, or any combination thereof.

In some embodiments, the magnetic-responsive additive comprises at least one of graphene, carbon nanotubes, graphene oxide, metal dichalcogenides, graphite, or any combination thereof.

In some embodiments, the magnetic array comprises at least one Halbach array of magnets, wherein the at least one Halbach array of magnetics is oriented about a central axis of the roller.

In some embodiments, when the composition is spread by the roller device on the roofing substrate and when the composition is cured, the magnetic-responsive additive is aligned in an orientation sufficient to result in a cured composition having a reflectivity that is at least two times greater than a reflectivity of a cured control composition, wherein the cured control composition is a composition which does not comprise the magnetic-responsive additive and/or is a composition which was not subjected to a magnetic field sufficient to increase a reflectivity of the cured control composition.

In some embodiments, the composition further comprises at least one of at least one filler, at least one adhesion promoter, at least one catalyst, at least one crosslinker, at least one pigment, or any combination thereof.

In some embodiments, the composition comprises 50% to 99% by weight of the polymer based on the total weight of the composition. In some embodiments, the composition comprises 1% to 10% by weight of the magnetic-responsive additive based on the total weight of the composition.

In some embodiments, the composition further comprises 0.1% to 10% by weight of at least one crosslinker based on the total weight of the composition. In some embodiments, the composition comprises 0.1% to 10% by weight of at least one catalyst based on the total weight of the composition.

Some embodiments relate to a method of installation. In some embodiments, the method of installation comprises obtaining a composition. In some embodiments, the composition comprises a polymer. In some embodiments, the polymer comprises at least one of a polysiloxane, a silyl-terminated polymer, or any combination thereof. In some embodiments, the composition comprises 1% to 50% by weight of a magnetic-responsive additive based on a total weight of the composition. In some embodiments, the method of installation comprises obtaining a roller device. In some embodiments, the roller device comprises a roller. In some embodiments, the roller contains a magnetic array. In some embodiments, the magnetic array is configured to apply a directional magnetic field. In some embodiments, the method of installation comprises contacting the roller of the roller device with the composition, so as to spread the composition onto at least a portion of a surface of a roofing substrate. In some embodiments, the method of installation comprises contacting the roller of the roller device with the composition, so as to magnetically align at least a portion of the magnetic-responsive additive in a horizontal orientation.

In some embodiments, the method of installation comprises curing the composition, so as to obtain a cured roofing membrane.

In some embodiments, the method of installation further comprises, before the contacting step, applying the composition to the roller of the roller device.

In some embodiments, the method of installation further comprises, before the contacting step, applying the composition to the surface of the roofing substrate.

In some embodiments, the curing comprises at least one of moisture-curing, heat curing, or any combination thereof.

In some embodiments, the composition comprises 90% to 99% by weight of the polymer based on the total weight of the composition. In some embodiments, the composition comprises 1% to 10% by weight of the magnetic-responsive additive based on the total weight of the composition.

In some embodiments, the composition comprises 95% to 99% by weight of the polymer based on the total weight of the composition. In some embodiments, the composition comprises 1% to 5% by weight of the magnetic-responsive additive based on the total weight of the composition.

In some embodiments, the magnetic-responsive additive is magnetically aligned in the horizontal orientation while the composition is spread onto at least a portion of the surface of the roofing substrate.

In some embodiments, the magnetic-responsive additive comprises at least one of graphene, carbon nanotubes, graphene oxide, metal dichalcogenides, graphite, or any combination thereof.

In some embodiments, the magnetic-responsive additive has a form of at least one of flakes, platelets, sheets, tubes, ribbons, rods, tubes, whiskers, fibers, spheres, cubes, or any combination thereof.

In some embodiments, a sufficient amount of the magnetic-responsive additive is magnetically aligned, by the magnetic array, in the horizontal orientation, so as to result in a cured roofing membrane having a reflectivity that is at least two times greater than a reflectivity of a cured control roofing membrane which does not comprise the magnetic-responsive additive.

Some embodiments relate to a roofing system. In some embodiments, the roofing system comprises a roofing substrate. In some embodiments, the roofing system comprises a cured roofing membrane located on the roofing substrate. In some embodiments, the cured roofing membrane comprises at least one of a polysiloxane, a silyl-terminated polymer, or any combination thereof. In some embodiments, the cured roofing membrane comprises 1% to 50% by weight of a magnetic-responsive additive based on a total weight of the cured roofing membrane. In some embodiments, a sufficient amount of the magnetic-responsive additive is magnetically aligned in a horizontal orientation, such that the cured roofing membrane has a reflectivity that is at least two times greater than a reflectivity of a cured roofing membrane which does not comprise the magnetic-responsive additive.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Figure 1:
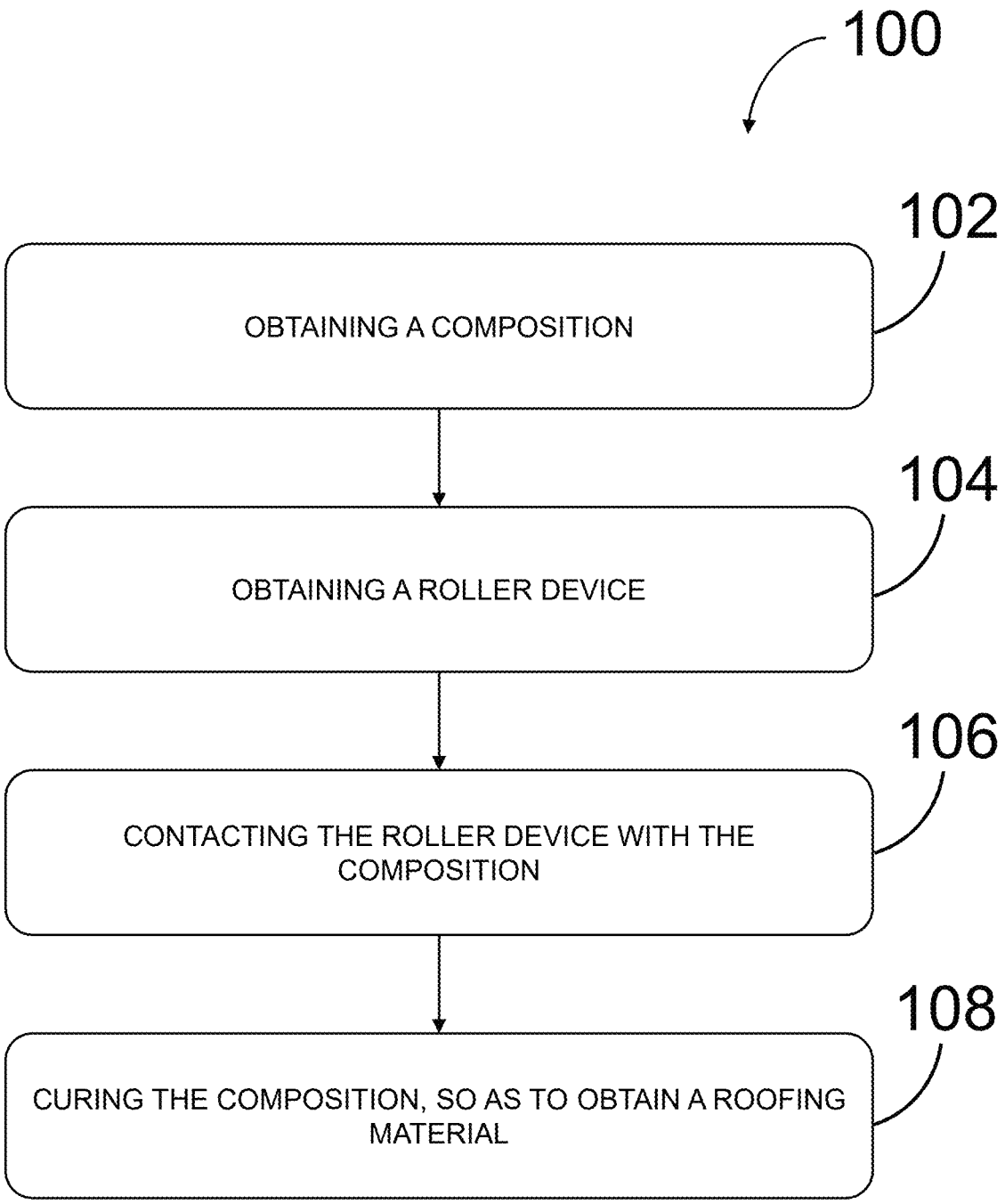
FIG. 1 is a flowchart of a method for installing a roofing material, according to some embodiments.

Some embodiments relate to magnetic-responsive compositions useful for roofing materials, related systems, and related methods. As used herein, the term "magnetic-responsive additive" refers to a substance that exhibits a response in a presence of a magnetic field. As used herein, the term "roofing material" includes, for example and without limitation, at least one of a roofing coating, a roofing membrane, a roofing shingle, a roofing substrate, a roofing accessory either in liquid or solid form, or any combination thereof. In some embodiments, a magnetic-responsive composition comprises a magnetically-responsive additive and a polymeric material. In some embodiments, prior to being cured, the magnetic-responsive composition is exposed to a magnetic field to tune or adjust one or more properties of the resulting roofing material. In some embodiments, for example, the magnetically-responsive additives are useful for improving a performance of the roofing material with respect to at least one of reflectivity, total solar reflectance, or any combination thereof. Some embodiments relate to compositions for forming roofing materials and related methods, among other things.

Some embodiments relate to a composition for forming a roofing material. In some embodiments, the composition comprises a polymeric material.

In some embodiments, the composition comprises 1% to 99% by weight of the polymeric material based on the total weight of the composition. In some embodiments, the composition comprises 1% to 95% by weight of the polymeric material based on the total weight of the composition. In some embodiments, the composition comprises 1% to 90% by weight of the polymeric material based on the total weight of the composition. In some embodiments, the composition comprises 1% to 85% by weight of the polymeric material based on the total weight of the composition. In some embodiments, the composition comprises 1% to 80% by weight of the polymeric material based on the total weight of the composition. In some embodiments, the composition comprises 1% to 75% by weight of the polymeric material based on the total weight of the composition. In some embodiments, the composition comprises 1% to 70% by weight of the polymeric material based on the total weight of the composition. In some embodiments, the composition comprises 1% to 65% by weight of the polymeric material based on the total weight of the composition. In some embodiments, the composition comprises 1% to 60% by weight of the polymeric material based on the total weight of the composition. In some embodiments, the composition comprises 1% to 55% by weight of the polymeric material based on the total weight of the composition. In some embodiments, the composition comprises 1% to 50% by weight of the polymeric material based on the total weight of the composition. In some embodiments, the composition comprises 1% to 45% by weight of the polymeric material based on the total weight of the composition. In some embodiments, the composition comprises 1% to 40% by weight of the polymeric material based on the total weight of the composition. In some embodiments, the composition comprises 1% to 35% by weight of the polymeric material based on the total weight of the composition. In some embodiments, the composition comprises 1% to 30% by weight of the polymeric material based on the total weight of the composition. In some embodiments, the composition comprises 1% to 25% by weight of the polymeric material based on the total weight of the composition. In some embodiments, the composition comprises 1% to 20% by weight of the polymeric material based on the total weight of the composition. In some embodiments, the composition comprises 1% to 15% by weight of the polymeric material based on the total weight of the composition. In some embodiments, the composition comprises 1% to 10% by weight of the polymeric material based on the total weight of the composition. In some embodiments, the composition comprises 1% to 5% by weight of the polymeric material based on the total weight of the composition.

In some embodiments, the composition comprises 5% to 99% by weight of the polymeric material based on the total weight of the composition. In some embodiments, the composition comprises 10% to 99% by weight of the polymeric material based on the total weight of the composition. In some embodiments, the composition comprises 15% to 99% by weight of the polymeric material based on the total weight of the composition. In some embodiments, the composition comprises 20% to 99% by weight of the polymeric material based on the total weight of the composition. In some embodiments, the composition comprises 25% to 99% by weight of the polymeric material based on the total weight of the composition. In some embodiments, the composition comprises 30% to 99% by weight of the polymeric material based on the total weight of the composition. In some embodiments, the composition comprises 35% to 99% by weight of the polymeric material based on the total weight of the composition. In some embodiments, the composition comprises 40% to 99% by weight of the polymeric material based on the total weight of the composition. In some embodiments, the composition comprises 45% to 99% by weight of the polymeric material based on the total weight of the composition. In some embodiments, the composition comprises 50% to 99% by weight of the polymeric material based on the total weight of the composition. In some embodiments, the composition comprises 55% to 99% by weight of the polymeric material based on the total weight of the composition. In some embodiments, the composition comprises 60% to 99% by weight of the polymeric material based on the total weight of the composition. In some embodiments, the composition comprises 65% to 99% by weight of the polymeric material based on the total weight of the composition. In some embodiments, the composition comprises 70% to 99% by weight of the polymeric material based on the total weight of the composition. In some embodiments, the composition comprises 75% to 99% by weight of the polymeric material based on the total weight of the composition. In some embodiments, the composition comprises 80% to 99% by weight of the polymeric material based on the total weight of the composition. In some embodiments, the composition comprises 85% to 99% by weight of the polymeric material based on the total weight of the composition. In some embodiments, the composition comprises 90% to 99% by weight of the polymeric material based on the total weight of the composition. In some embodiments, the composition comprises 95% to 99% by weight of the polymeric material based on the total weight of the composition.

In some embodiments, the polymeric material comprises at least one of a monomer, an oligomer, a polymer, or any combination thereof. In some embodiments, the polymer comprises at least one of a homopolymer, a copolymer, or any combination thereof. In some embodiments, the polymeric material comprises a silicon-containing polymer. In some embodiments, the polymeric material comprises a crosslinkable polymer.

In some embodiments, the polymeric material comprises at least one of a polysiloxane, a silyl-terminated polymer, or any combination thereof. In some embodiments, the polymeric material comprises at least one of a linear polysiloxane, a cyclic polysiloxane, a branched polysiloxane, or any combination thereof. In some embodiments, the polymeric material comprises at least one of a silyl-terminated polyurethane, a silyl-terminated polyether, a silyl-terminated acrylic, a silyl-terminated polyester, or any combination thereof. In some embodiments, the polymeric material comprises at least one of polyester, polyethylene, polypropylene, polyurethane, polyurea, or any combination thereof. In some embodiments, the polymeric material comprises at least one of a liquid silicone resin, a liquid silicone rubber resin (LSR), a heat cured silicone resin, a silicone gum, or any combination thereof. In some embodiments, the polymeric material comprises at least one of a linear polysiloxane, a cyclic polysiloxane, a branched polysiloxane, polyester, polyethylene, polypropylene, polyurethane, polyurea, a liquid silicone resin, a liquid silicone rubber resin (LSR), a heat cured silicone resin, a silicone gum, a polyolefin, a polycarbonate, a polyether, a silyl-terminated polyurethane, a silyl-terminated polyether, a silyl-terminated acrylic, a silyl-terminated polyester, or any combination thereof.

In some embodiments, the polymeric material comprises a polysiloxane. As used herein, a "polysiloxane" is a polymer that includes at least two of the following repeat units: $—R_2Si—O—SiR_2—$, where R is an organic group, or hydrogen. As used herein, an "organic group" may encompass any organosilicon group, such as but not limited to a silanol group or an alkyl silyl group. In some embodiments, each R is independently a hydrogen, an alkyl, an alkenyl, or an aryl. In some embodiments, each R is independently a hydrogen, a methyl, a phenyl, or a vinyl. In some embodiments, a terminal group of the polysiloxane is a terminal group of the formula: $—OSiR_3$, wherein each R is independently a hydrogen, an alkyl, an alkenyl, an aryl, or a hydroxyl. For example, in some embodiments, each R of the terminal group is independently a hydrogen, a methyl, a vinyl, or a hydroxyl. In some embodiments, a polysiloxane may include ten or more of the aforementioned repeat units. In some embodiments, a polysiloxane may include hundreds of the aforementioned repeat units. In some embodiments, a polysiloxane may include thousands of the aforementioned repeat units. In some embodiments, a polysiloxane may include tens-of-thousands of the aforementioned repeat units. In some embodiments, a polysiloxane may include hundreds-of-thousands of the aforementioned repeat units. In some embodiments, a polysiloxane may include millions of the aforementioned repeat units. As used herein, a "polysiloxane" may also include any version of the aforementioned formula where at least one of the R groups is substituted with an organic group. In some embodiments, the polysiloxane is unsubstituted, such that all of the R groups may be the same. In some embodiments, the polysiloxane is substituted such that some of the R groups may be the same while others may differ from each other. In some embodiments, the polysiloxane is substituted such that all of the R groups are different. In some embodiments, the polysiloxane is substituted or "terminated" with an organic group at the end of a polymer chain.

In some embodiments, the polysiloxane comprises or is selected from the group consisting of a hydroxy terminated polysiloxane, a di-hydroxy terminated polysiloxane, a vinyl terminated polysiloxane, a di-vinyl terminated polysiloxane, a tri-methyl-silyl terminated polysiloxane, a mono-trimethoxy terminated polysiloxane, a silanol terminated polysiloxane, or any combination thereof.

In some embodiments, the polysiloxane comprises, or is selected from the group consisting of a hydroxy terminated polysiloxane, a di-hydroxy terminated polysiloxane, a vinyl terminated polysiloxane, a di-vinyl terminated polysiloxane, a tri-methyl-silyl terminated polysiloxane, or any combination thereof.

In some embodiments, the polysiloxane comprises or is selected from the group consisting of a mono-trimethoxy terminated polysiloxane, a silanol terminated polysiloxane, or any combination thereof.

In some embodiments, the polysiloxane comprises, consists, or consists essentially of a mono-trimethoxy terminated polysiloxane. In some embodiments, the polysiloxane comprises, consists, or consists essentially of a silanol terminated polysiloxane.

As used herein, a "silane" is any compound having the general formula $Si_nR_{2n+2}$, where R is hydrogen, an organic group, or any combination thereof. As used herein, a "silane" may also include any version of the aforementioned formula where at least one of the R groups is substituted with an organic group. In some embodiments, the silane is unsubstituted, such that all of the R groups may be the same. In some embodiments, the silane is substituted such that some of the R groups may be the same while others may differ from each other. In some embodiments, the silane is substituted such that all of the R groups are different. Examples of at least one substituent R group may include, but is not limited to at least one amino group (in the non-limiting case of an aminosilane) and at least one methoxy group (in the non-limiting case of a methoxysilane).

In some embodiments, a silane may also encompass a bipodal silane. As used herein, a "bipodal silane" is a silane having the general formula $R_3Si—R—SiR_3$.

In some embodiments, the at least one silane comprises or is selected from the group consisting of an associative silane, a non-associative silane, or any combination thereof. In some embodiments, the at least one silane comprises, consists, or consists essentially of an associative silane. In some embodiments, the at least one silane comprises, consists, or consists essentially of a non-associative silane.

As used herein, an "associative silane" is a silane having the general formula $Si(R^1)_n(R^2)_{n+2}$; where each $R^1$ group is a crosslinkable functional group, such as but not limited to, an alkoxy group, acetoxy group, or an oxime group; and where at least one of the $R^2$ groups is a functional group that interacts with another $R^2$ group, interacts with another component in a composition, or any combination thereof. In some embodiments, the interaction occurs by an interaction mechanism, such as but not limited to, hydrogen bonding, electrostatic attraction, π-π stacking, or any combination thereof.

As used herein a "non-associative silane" is any silane that is not an "associative silane."

In some embodiments, the associative silane comprises or is selected from the group consisting of an epoxysilane, an aminosilane, a diphenylsilane, or any combination thereof.

In some embodiments, the associative silane comprises or is selected from the group consisting of methacryloxypropyltrimethoxysilane, mercaptopropyltrimethoxysilane methacryloxypropylmethyldimethoxysilane, diphenyldimethoxysilane, an epoxy silane oligomer, glycidoxypropyltrimethoxysilane, aminoethylaminopropyltrimethoxysilane, or any combination thereof.

In some embodiments, the associative silane comprises or is selected from the group consisting of methacryloxypropyltrimethoxysilane, mercaptopropyltrimethoxysilane methacryloxypropylmethyldimethoxysilane, diphenyldimethoxysilane, an epoxy silane oligomer, or any combination thereof.

In some embodiments, the associative silane comprises or is selected from the group consisting of glycidoxypropyltrimethoxysilane, aminoethylaminopropyltrimethoxysilane, or any combination thereof.

In some embodiments, the associative silane comprises, consists, or consists essentially of glycidoxypropyltrimethoxysilane.

In some embodiments, the associative silane comprises, consists, or consists essentially of aminoethylaminopropyltrimethoxysilane.

In some embodiments, the non-associative silane is octylsilane.

In some embodiments, the non-associative silane comprises or is selected from the group consisting of octyltrimethoxysilane, vinyltrimethoxysilane, or any combination thereof.

In some embodiments, the non-associative silane is vinyltrimethoxysilane.

In some embodiments, the non-associative silane is octyltrimethoxysilane.

In some embodiments, the composition comprises at least one bipodal silane. Non-limiting examples of a bipodal silane include bis(trimethoxysilylpropyl)amine (commercially available as Andisil® 1170) and bis [3-(triethoxysilyl) propyl] tetrasulfide (commercially available as Andisil® 1289).

In some embodiments, the composition does not comprise a bipodal silane.

In some embodiments, the composition may exclude certain specific bipodal silanes. For instance, in some embodiments, the composition does not comprise bis-(triethoxysilyl) ethane, bis(trimethoxysilylpropyl)amine, bis [3-(triethoxysilyl) propyl] tetrasulfide, or any combination thereof.

In some embodiments, the polysiloxane comprises a silanol-terminated polysiloxane. In some embodiments, the polysiloxane comprises a silanol-terminated polydimethylsiloxane. In some embodiments, the polysiloxane comprises trimethylsilyl-terminated polydimethylsiloxane polymer.

Examples of hydroxyl-terminated polysiloxanes include, without limitation, Andisil® OH Polymers, such as, for example and without limitation, at least one of Andisil® OH 750 Silanol terminated 750 cps; Andisil® OH 1,000 Silanol terminated 1,000 cps; Andisil® OH 2,000 Silanol terminated 2,000 cps; Andisil® OH 3,500 Silanol terminated 3,500 cps; Andisil® OH 4,000 Silanol terminated 4,000 cps; Andisil® OH 6,000 Silanol terminated 6,000 cps; Andisil® OH 14,000 Silanol terminated 14,000 cps; Andisil® OH 20,000 Silanol terminated 20,000 cps; Andisil® OH 50,000 Silanol terminated 50,000 cps; Andisil® OH 80,000 Silanol terminated 80,000 cps; Andisil® OH 300,000 Silanol terminated 300,000 cps; or any combination thereof.

In some embodiments, the polymeric material is derived from any one or more of the above polymers.

In some embodiments, the composition comprises a magnetic-responsive additive.

In some embodiments, the magnetic-responsive additive comprises a substance that exhibits a response in a presence of a magnetic field. In some embodiments, the response of the magnetic-responsive additive in a presence of a magnetic field is a change in an orientation of the magnetic-responsive additive. In some embodiments, the response of the magnetic-responsive additive in a presence of a magnetic field is an alignment of the magnetic-responsive additive. In some embodiments, the response of the magnetic-responsive additive in a presence of a magnetic field is a chemical change to the magnetic-responsive additive and/or the composition. In some embodiments, the response of the magnetic-responsive additive in a presence of a magnetic field is a physical change to the magnetic-responsive additive and/or the composition. In some embodiments, the response of the magnetic-responsive additive in a presence of a magnetic field is a change in a property of the magnetic-responsive additive and/or the composition and/or resulting roofing material. In some embodiments, the property comprises at least one of reflectivity, total solar reflectance, or any combination thereof.

In some embodiments, the composition comprises 1% to 50% by weight of the magnetic-responsive additive based on the total weight of the composition. In some embodiments, the composition comprises 1% to 45% by weight of the magnetic-responsive additive based on the total weight of the composition. In some embodiments, the composition comprises 1% to 40% by weight of the magnetic-responsive additive based on the total weight of the composition. In some embodiments, the composition comprises 1% to 35% by weight of the magnetic-responsive additive based on the total weight of the composition. In some embodiments, the composition comprises 1% to 30% by weight of the magnetic-responsive additive based on the total weight of the composition. In some embodiments, the composition comprises 1% to 25% by weight of the magnetic-responsive additive based on the total weight of the composition. In some embodiments, the composition comprises 1% to 20% by weight of the magnetic-responsive additive based on the total weight of the composition. In some embodiments, the composition comprises 1% to 19% by weight of the magnetic-responsive additive based on the total weight of the composition. In some embodiments, the composition comprises 1% to 18% by weight of the magnetic-responsive additive based on the total weight of the composition. In some embodiments, the composition comprises 1% to 17% by weight of the magnetic-responsive additive based on the total weight of the composition. In some embodiments, the composition comprises 1% to 16% by weight of the magnetic-responsive additive based on the total weight of the composition. In some embodiments, the composition comprises 1% to 15% by weight of the magnetic-responsive additive based on the total weight of the composition. In some embodiments, the composition comprises 1% to 14% by weight of the magnetic-responsive additive based on the total weight of the composition. In some embodiments, the composition comprises 1% to 13% by weight of the magnetic-responsive additive based on the total weight of the composition. In some embodiments, the composition comprises 1% to 12% by weight of the magnetic-responsive additive based on the total weight of the composition. In some embodiments, the composition comprises 1% to 11% by weight of the magnetic-responsive additive based on the total weight of the composition. In some embodiments, the composition comprises 1% to 10% by weight of the magnetic-responsive additive based on the total weight of the composition. In some embodiments, the composition comprises 1% to 9% by weight of the magnetic-responsive additive based on the total weight of the composition. In some embodiments, the composition comprises 1% to 8% by weight of the magnetic-responsive additive based on the total weight of the composition. In some embodiments, the composition comprises 1% to 7% by weight of the magnetic-responsive additive based on the total weight of the composition. In some embodiments, the composition comprises 1% to 6% by weight of the magnetic-responsive additive based on the total weight of the composition. In some embodiments, the composition comprises 1% to 5% by weight of the magnetic-responsive additive based on the total weight of the composition. In some embodiments, the composition comprises 1% to 4% by weight of the magnetic-responsive additive based on the total weight of the composition. In some embodiments, the composition comprises 1% to 3% by weight of the magnetic-responsive additive based on the total weight of the composition. In some embodiments, the composition comprises 1% to 2% by weight of the magnetic-responsive additive based on the total weight of the composition.

In some embodiments, the composition comprises 2% to 50% by weight of the magnetic-responsive additive based on the total weight of the composition. In some embodiments, the composition comprises 3% to 50% by weight of the magnetic-responsive additive based on the total weight of the composition. In some embodiments, the composition comprises 4% to 50% by weight of the magnetic-responsive additive based on the total weight of the composition. In some embodiments, the composition comprises 5% to 50% by weight of the magnetic-responsive additive based on the total weight of the composition. In some embodiments, the composition comprises 6% to 50% by weight of the magnetic-responsive additive based on the total weight of the composition. In some embodiments, the composition comprises 7% to 50% by weight of the magnetic-responsive additive based on the total weight of the composition. In some embodiments, the composition comprises 8% to 50% by weight of the magnetic-responsive additive based on the total weight of the composition. In some embodiments, the composition comprises 9% to 50% by weight of the magnetic-responsive additive based on the total weight of the composition. In some embodiments, the composition comprises 10% to 50% by weight of the magnetic-responsive additive based on the total weight of the composition. In some embodiments, the composition comprises 11% to 50% by weight of the magnetic-responsive additive based on the total weight of the composition. In some embodiments, the composition comprises 12% to 50% by weight of the magnetic-responsive additive based on the total weight of the composition. In some embodiments, the composition comprises 13% to 50% by weight of the magnetic-responsive additive based on the total weight of the composition. In some embodiments, the composition comprises 14% to 50% by weight of the magnetic-responsive additive based on the total weight of the composition. In some embodiments, the composition comprises 15% to 50% by weight of the magnetic-responsive additive based on the total weight of the composition. In some embodiments, the composition comprises 16% to 50% by weight of the magnetic-responsive additive based on the total weight of the composition. In some embodiments, the composition comprises 17% to 50% by weight of the magnetic-responsive additive based on the total weight of the composition. In some embodiments, the composition comprises 18% to 50% by weight of the magnetic-responsive additive based on the total weight of the composition. In some embodiments, the composition comprises 19% to 50% by weight of the magnetic-responsive additive based on the total weight of the composition. In some embodiments, the composition comprises 20% to 50% by weight of the magnetic-responsive additive based on the total weight of the composition. In some embodiments, the composition comprises 25% to 50% by weight of the magnetic-responsive additive based on the total weight of the composition. In some embodiments, the composition comprises 30% to 50% by weight of the magnetic-responsive additive based on the total weight of the composition. In some embodiments, the composition comprises 35% to 50% by weight of the magnetic-responsive additive based on the total weight of the composition. In some embodiments, the composition comprises 40% to 50% by weight of the magnetic-responsive additive based on the total weight of the composition. In some embodiments, the composition comprises 45% to 50% by weight of the magnetic-responsive additive based on the total weight of the composition.

In some embodiments, the composition comprises 0.5% to 20% by volume of the magnetic-responsive additive based on a total volume of the composition. In some embodiments, the composition comprises 0.5% to 19%, 0.5% to 18%, 0.5% to 17%, 0.5% to 16%, 0.5% to 15%, 0.5% to 14%, 0.5% to 13%, 0.5% to 12%, 0.5% to 11%, 0.5% to 10%, 0.5% to 9%, 0.5% to 8%, 0.5% to 7%, 0.5% to 6%, 0.5% to 5%, 0.5% to 4%, 0.5% to 3%, 0.5% to 2%, 0.5% to 1%, 1% to 20%, 2% to 20%, 3% to 20%, 4% to 20%, 5% to 20%, 6% to 20%, 7% to 20%, 8% to 20%, 9% to 20%, 10% to 20%, 11% to 20%, 12% to 20%, 13% to 20%, 14% to 20%, 15% to 20%, 16% to 20%, 17% to 20%, 18% to 20%, or 19% to 20% by volume of the magnetic-responsive additive based on a total volume of the composition.

In some embodiments, the magnetic-responsive additive comprises a paramagnetic additive. In some embodiments, the paramagnetic additive has a low susceptibility to and are weakly influenced by a magnetic field. In some embodiments, the magnetic-responsive additive comprises a diamagnetic additive. In some embodiments, the diamagnetic additive is negligibly affected by magnetic fields, and can be slightly repelled by a magnetic field. In some embodiments, the magnetic-responsive additive comprises a ferromagnetic additive. In some embodiments, the ferromagnetic additive has a strong susceptibility and attraction to a magnetic field and can retain magnetic properties once the field is removed.

In some embodiments, the magnetic-responsive additive has a form of at least one of particles, flakes, platelets, sheets, tubes, ribbons, rods, tubes, whiskers, fibers, spheres, cubes, or any combination thereof. In some embodiments, the magnetic-responsive additive comprises graphene. In some embodiments, the magnetic-responsive additive comprises carbon nanotubes. In some embodiments, the magnetic-responsive additive comprises graphene oxide. In some embodiments, the magnetic-responsive additive comprises metal dichalcogenides. In some embodiments, the magnetic-responsive additive comprises graphite (e.g., a highly ordered pyrolytic graphite). In some embodiments, the magnetic-responsive additive comprises at least one of graphene, carbon nanotubes, graphene oxide, metal dichalcogenides, graphite, or any combination thereof.

In some embodiments, the graphene comprises a carbon nanomaterial. In some embodiments, the graphene comprises a two-dimensional arrangement of carbon atoms. In some embodiments, the graphene comprises a single layer of atoms arranged in a two-dimensional lattice (e.g., a two-dimensional honeycomb lattice, etc.). In some embodiments, the graphene is present in a form of at least one of a powder, a pellet, a flake, a rod, a fiber, a sphere, a film, an agglomerate, or any combination thereof. For example, in some embodiments, the graphene comprises graphene particles, such as, for example, graphene nanoparticles. In some embodiments, the graphene is a plurality of graphene particles. In some embodiments, the graphene may be combined with or replaced by at least one other carbon nanomaterial. Examples of other carbon nanomaterials include, without limitation, graphite, carbon nanostructures (e.g., carbon nanotubes, etc.), fullerenes, or any combination thereof. In some embodiments, the graphene may be combined with or replaced by at least one of a graphite, a carbon nanotube, a fullerene, a composite thereof, or any combination thereof. In some embodiments, the term graphene refers to graphene combined with at least one of a graphite, a carbon nanotube, a fullerene, or any combination thereof to form a composite. In some embodiments, the term graphene refers to graphene only. For example, in some embodiments, the graphene may not be combined with any other carbon nanomaterial.

In some embodiments, the magnetic-responsive additive comprises a metal that is magnetic or can be influenced by a magnetic field. In some embodiments, for example, the magnetic-responsive additive comprises at least one of iron, nickel, cobalt, vanadium, molybdenum, or any combination thereof. In some embodiments, the magnetic-responsive additive comprises at least one of an alloy comprising aluminum, iron, cobalt and nickel; steel, samarium cobalt (SmCo), neodymium iron boron (NdFeB), ferrites, $Fe_2O_3$, $FeOFe_2O_3$, $NiOFe_2O_3$, $CuOFe_2O_3$, $MgOFe_2O_3$, MnBi, MnSb, $Ni_2Fe$, $Ni_3Fe$, CoFe, $CrO_2$, MnAs, any alloy thereof, or any combination thereof. In some embodiments, an alloy comprising a combination of magnetic materials and non-magnetic materials may also be used. In some embodiments, the non-magnetic materials present in the alloys comprise at least one of metals, ceramics, polymers, or any combination thereof.

In some embodiments, the magnetic-responsive additive has a lateral size. As used herein, the term "lateral size" of the magnetic-responsive additive refers to a dimension or an average dimension of at least a portion of the magnetic-responsive additive. In some embodiments, the lateral size of the magnetic-responsive additive may depend on a shape or a general shape of the magnetic-responsive additive, a form of the magnetic-responsive additive (e.g., as a powder, a pellet, a sheet, etc.), a type of the magnetic-responsive additive (e.g., carbon nanotubes, graphite, etc.), or any combination thereof. In some embodiments, for example, the lateral size of magnetic-responsive additive may refer to at least one of a radius, a thickness, a diameter, a length, a width, a diagonal, or any combination thereof.

In some embodiments, the magnetic-responsive additive has a lateral size of 1 μm to 1000 μm. In some embodiments, the magnetic-responsive additive has a lateral size of 1 μm to 950 μm. In some embodiments, the magnetic-responsive additive has a lateral size of 1 μm to 900 μm. In some embodiments, the magnetic-responsive additive has a lateral size of 1 μm to 850 μm. In some embodiments, the magnetic-responsive additive has a lateral size of 1 μm to 800 μm. In some embodiments, the magnetic-responsive additive has a lateral size of 1 μm to 750 μm. In some embodiments, the magnetic-responsive additive has a lateral size of 1 μm to 700 μm. In some embodiments, the magnetic-responsive additive has a lateral size of 1 μm to 650 μm. In some embodiments, the magnetic-responsive additive has a lateral size of 1 μm to 600 μm. In some embodiments, the magnetic-responsive additive has a lateral size of 1 μm to 550 μm. In some embodiments, the magnetic-responsive additive has a lateral size of 1 μm to 500 μm. In some embodiments, the magnetic-responsive additive has a lateral size of 1 μm to 450 μm. In some embodiments, the magnetic-responsive additive has a lateral size of 1 μm to 400 μm. In some embodiments, the magnetic-responsive additive has a lateral size of 1 μm to 350 μm. In some embodiments, the magnetic-responsive additive has a lateral size of 1 μm to 300 μm. In some embodiments, the magnetic-responsive additive has a lateral size of 1 μm to 250 μm. In some embodiments, the magnetic-responsive additive has a lateral size of 1 μm to 200 μm. In some embodiments, the magnetic-responsive additive has a lateral size of 1 μm to 150 μm. In some embodiments, the magnetic-responsive additive has a lateral size of 1 μm to 100 μm. In some embodiments, the magnetic-responsive additive has a lateral size of 1 μm to 50 μm. In some embodiments, the magnetic-responsive additive has a lateral size of 1 μm to 45 μm. In some embodiments, the magnetic-responsive additive has a lateral size of 1 μm to 40 μm. In some embodiments, the magnetic-responsive additive has a lateral size of 1 μm to 35 μm. In some embodiments, the magnetic-responsive additive has a lateral size of 1 μm to 30 μm. In some embodiments, the magnetic-responsive additive has a lateral size of 1 μm to 25 μm. In some embodiments, the magnetic-responsive additive has a lateral size of 1 μm to 20 μm. In some embodiments, the magnetic-responsive additive has a lateral size of 1 μm to 15 μm. In some embodiments, the magnetic-responsive additive has a lateral size of 1 μm to 10 μm. In some embodiments, the magnetic-responsive additive has a lateral size of 1 μm to 5 μm.

In some embodiments, the magnetic-responsive additive has a lateral size of 50 μm to 1000 μm. In some embodiments, the magnetic-responsive additive has a lateral size of 100 μm to 1000 μm. In some embodiments, the magnetic-responsive additive has a lateral size of 150 μm to 1000 μm. In some embodiments, the magnetic-responsive additive has a lateral size of 200 μm to 1000 μm. In some embodiments, the magnetic-responsive additive has a lateral size of 250 μm to 1000 μm. In some embodiments, the magnetic-responsive additive has a lateral size of 300 μm to 1000 μm. In some embodiments, the magnetic-responsive additive has a lateral size of 350 μm to 1000 μm. In some embodiments, the magnetic-responsive additive has a lateral size of 400 μm to 1000 μm. In some embodiments, the magnetic-responsive additive has a lateral size of 450 μm to 1000 μm. In some embodiments, the magnetic-responsive additive has a lateral size of 500 μm to 1000 μm. In some embodiments, the magnetic-responsive additive has a lateral size of 550 μm to 1000 μm. In some embodiments, the magnetic-responsive additive has a lateral size of 600 μm to 1000 μm. In some embodiments, the magnetic-responsive additive has a lateral size of 650 μm to 1000 μm. In some embodiments, the magnetic-responsive additive has a lateral size of 700 μm to 1000 μm. In some embodiments, the magnetic-responsive additive has a lateral size of 750 μm to 1000 μm. In some embodiments, the magnetic-responsive additive has a lateral size of 800 μm to 1000 μm. In some embodiments, the magnetic-responsive additive has a lateral size of 850 μm to 1000 μm. In some embodiments, the magnetic-responsive additive has a lateral size of 900 μm to 1000 μm. In some embodiments, the magnetic-responsive additive has a lateral size of 950 μm to 1000 μm.

In some embodiments, the composition comprises a silicone fluid.

In some embodiments, the composition comprises 1% to 30% by weight of the silicone fluid based on the total weight of the composition. In some embodiments, the composition comprises 2% to 30% by weight of the silicone fluid based on the total weight of the composition. In some embodiments, the composition comprises 4% to 30% by weight of the silicone fluid based on the total weight of the composition. In some embodiments, the composition comprises 5% to 30% by weight of the silicone fluid based on the total weight of the composition. In some embodiments, the composition comprises 6% to 30% by weight of the silicone fluid based on the total weight of the composition. In some embodiments, the composition comprises 8% to 30% by weight of the silicone fluid based on the total weight of the composition. In some embodiments, the composition comprises 10% to 30% by weight of the silicone fluid based on the total weight of the composition. In some embodiments, the composition comprises 12% to 30% by weight of the silicone fluid based on the total weight of the composition. In some embodiments, the composition comprises 14% to 30% by weight of the silicone fluid based on the total weight of the composition. In some embodiments, the composition comprises 15% to 30% by weight of the silicone fluid based on the total weight of the composition. In some embodiments, the composition comprises 16% to 30% by weight of the silicone fluid based on the total weight of the composition. In some embodiments, the composition comprises 18% to 30% by weight of the silicone fluid based on the total weight of the composition. In some embodiments, the composition comprises 20% to 30% by weight of the silicone fluid based on the total weight of the composition. In some embodiments, the composition comprises 22% to 30% by weight of the silicone fluid based on the total weight of the composition. In some embodiments, the composition comprises 24% to 30% by weight of the silicone fluid based on the total weight of the composition. In some embodiments, the composition comprises 25% to 30% by weight of the silicone fluid based on the total weight of the composition. In some embodiments, the composition comprises 26% to 30% by weight of the silicone fluid based on the total weight of the composition. In some embodiments, the composition comprises 28% to 30% by weight of the silicone fluid based on the total weight of the composition.

In some embodiments, the composition comprises 1% to 28% by weight of the silicone fluid based on the total weight of the composition. In some embodiments, the composition comprises 1% to 26% by weight of the silicone fluid based on the total weight of the composition. In some embodiments, the composition comprises 1% to 25% by weight of the silicone fluid based on the total weight of the composition. In some embodiments, the composition comprises 1% to 24% by weight of the silicone fluid based on the total weight of the composition. In some embodiments, the composition comprises 1% to 22% by weight of the silicone fluid based on the total weight of the composition. In some embodiments, the composition comprises 1% to 20% by weight of the silicone fluid based on the total weight of the composition. In some embodiments, the composition comprises 1% to 18% by weight of the silicone fluid based on the total weight of the composition. In some embodiments, the composition comprises 1% to 16% by weight of the silicone fluid based on the total weight of the composition. In some embodiments, the composition comprises 1% to 15% by weight of the silicone fluid based on the total weight of the composition. In some embodiments, the composition comprises 1% to 14% by weight of the silicone fluid based on the total weight of the composition. In some embodiments, the composition comprises 1% to 12% by weight of the silicone fluid based on the total weight of the composition. In some embodiments, the composition comprises 1% to 10% by weight of the silicone fluid based on the total weight of the composition. In some embodiments, the composition comprises 1% to 8% by weight of the silicone fluid based on the total weight of the composition. In some embodiments, the composition comprises 1% to 6% by weight of the silicone fluid based on the total weight of the composition. In some embodiments, the composition comprises 1% to 5% by weight of the silicone fluid based on the total weight of the composition. In some embodiments, the composition comprises 1% to 4% by weight of the silicone fluid based on the total weight of the composition. In some embodiments, the composition comprises 1% to 2% by weight of the silicone fluid based on the total weight of the composition.

In some embodiments, the silicone fluid comprises an inert silicone fluid. In some embodiments, the silicone fluid comprises at least one of a linear silicone, a cyclic silicone, a branched silicone, or any combination thereof. In some embodiments, the silicone fluid comprises at least one of octamethylcyclotetrasiloxane, decamethylcyclopentasiloxane, trimethylsilyl terminated linear polydimethylsiloxane, or any combination thereof.

In some embodiments, the composition comprises at least one filler.

In some embodiments, the composition comprises 1% to 70% by weight of the at least one filler based on the total weight of the composition. In some embodiments, the composition comprises 5% to 70% by weight of the at least one filler based on the total weight of the composition. In some embodiments, the composition comprises 10% to 70% by weight of the at least one filler based on the total weight of the composition. In some embodiments, the composition comprises 15% to 70% by weight of the at least one filler based on the total weight of the composition. In some embodiments, the composition comprises 20% to 70% by weight of the at least one filler based on the total weight of the composition. In some embodiments, the composition comprises 25% to 70% by weight of the at least one filler based on the total weight of the composition. In some embodiments, the composition comprises 30% to 70% by weight of the at least one filler based on the total weight of the composition. In some embodiments, the composition comprises 35% to 70% by weight of the at least one filler based on the total weight of the composition. In some embodiments, the composition comprises 40% to 70% by weight of the at least one filler based on the total weight of the composition. In some embodiments, the composition comprises 45% to 70% by weight of the at least one filler based on the total weight of the composition. In some embodiments, the composition comprises 50% to 70% by weight of the at least one filler based on the total weight of the composition. In some embodiments, the composition comprises 55% to 70% by weight of the at least one filler based on the total weight of the composition. In some embodiments, the composition comprises 60% to 70% by weight of the at least one filler based on the total weight of the composition. In some embodiments, the composition comprises 65% to 70% by weight of the at least one filler based on the total weight of the composition.

In some embodiments, the composition comprises 1% to 65% by weight of the at least one filler based on the total weight of the composition. In some embodiments, the composition comprises 1% to 60% by weight of the at least one filler based on the total weight of the composition. In some embodiments, the composition comprises 1% to 55% by weight of the at least one filler based on the total weight of the composition. In some embodiments, the composition comprises 1% to 50% by weight of the at least one filler based on the total weight of the composition. In some embodiments, the composition comprises 1% to 45% by weight of the at least one filler based on the total weight of the composition. In some embodiments, the composition comprises 1% to 40% by weight of the at least one filler based on the total weight of the composition. In some embodiments, the composition comprises 1% to 35% by weight of the at least one filler based on the total weight of the composition. In some embodiments, the composition comprises 1% to 30% by weight of the at least one filler based on the total weight of the composition. In some embodiments, the composition comprises 1% to 25% by weight of the at least one filler based on the total weight of the composition. In some embodiments, the composition comprises 1% to 20% by weight of the at least one filler based on the total weight of the composition. In some embodiments, the composition comprises 1% to 15% by weight of the at least one filler based on the total weight of the composition. In some embodiments, the composition comprises 1% to 10% by weight of the at least one filler based on the total weight of the composition. In some embodiments, the composition comprises 1% to 5% by weight of the at least one filler based on the total weight of the composition.

In some embodiments, the at least one filler comprises at least one of nepheline syenite, calcium carbonate, barium sulfate, iron oxide, diatomaceous earth, melamine, quartz, silica, colloidal silica, crystalline silica, precipitated silica, amorphous silica, titanium dioxide, alumina trihydrate, zinc oxide, zirconium oxide, zirconium silicate, zinc borate, chromic oxide, crystalline silica fine powder, amorphous silica fine powder, silicone rubber powder, glass, glass bubbles, glass powder, zeolites, silica hydrogen, silica aero gel, calcium silicate, aluminum silicate, aluminum oxide, ferrite, carbon black, graphite, mica, clay, bentonite, ground quartz, kaolin, calcined kaolin, wollastonite, hydroxyapatite, hydrated alumina, magnesium hydroxide, vermiculite, talcum, slaked lime, or any combination thereof. In some embodiments, the at least one filler comprises at least one non-magnetic filler.

In some embodiments, the composition comprises a fumed silica.

In some embodiments, the composition comprises 0.1% to 20% by weight of the fumed silica based on the total weight of the composition. In some embodiments, the composition comprises 0.5% to 20% by weight of the fumed silica based on the total weight of the composition. In some embodiments, the composition comprises 1% to 20% by weight of the fumed silica based on the total weight of the composition. In some embodiments, the composition comprises 2% to 20% by weight of the fumed silica based on the total weight of the composition. In some embodiments, the composition comprises 4% to 20% by weight of the fumed silica based on the total weight of the composition. In some embodiments, the composition comprises 5% to 20% by weight of the fumed silica based on the total weight of the composition. In some embodiments, the composition comprises 6% to 20% by weight of the fumed silica based on the total weight of the composition. In some embodiments, the composition comprises 8% to 20% by weight of the fumed silica based on the total weight of the composition. In some embodiments, the composition comprises 10% to 20% by weight of the fumed silica based on the total weight of the composition. In some embodiments, the composition comprises 12% to 20% by weight of the fumed silica based on the total weight of the composition. In some embodiments, the composition comprises 14% to 20% by weight of the fumed silica based on the total weight of the composition. In some embodiments, the composition comprises 15% to 20% by weight of the fumed silica based on the total weight of the composition. In some embodiments, the composition comprises 16% to 20% by weight of the fumed silica based on the total weight of the composition. In some embodiments, the composition comprises 18% to 20% by weight of the fumed silica based on the total weight of the composition.

In some embodiments, the composition comprises 0.1% to 18% by weight of the fumed silica based on the total weight of the composition. In some embodiments, the composition comprises 0.1% to 16% by weight of the fumed silica based on the total weight of the composition. In some embodiments, the composition comprises 0.1% to 15% by weight of the fumed silica based on the total weight of the composition. In some embodiments, the composition comprises 0.1% to 14% by weight of the fumed silica based on the total weight of the composition. In some embodiments, the composition comprises 0.1% to 12% by weight of the fumed silica based on the total weight of the composition. In some embodiments, the composition comprises 0.1% to 10% by weight of the fumed silica based on the total weight of the composition. In some embodiments, the composition comprises 0.1% to 8% by weight of the fumed silica based on the total weight of the composition. In some embodiments, the composition comprises 0.1% to 6% by weight of the fumed silica based on the total weight of the composition. In some embodiments, the composition comprises 0.1% to 5% by weight of the fumed silica based on the total weight of the composition. In some embodiments, the composition comprises 0.1% to 4% by weight of the fumed silica based on the total weight of the composition. In some embodiments, the composition comprises 0.1% to 2% by weight of the fumed silica based on the total weight of the composition. In some embodiments, the composition comprises 0.1% to 1% by weight of the fumed silica based on the total weight of the composition. In some embodiments, the composition comprises 0.1% to 0.8% by weight of the fumed silica based on the total weight of the composition. In some embodiments, the composition comprises 0.1% to 0.6% by weight of the fumed silica based on the total weight of the composition. In some embodiments, the composition comprises 0.1% to 0.5% by weight of the fumed silica based on the total weight of the composition. In some embodiments, the composition comprises 0.1% to 0.4% by weight of the fumed silica based on the total weight of the composition. In some embodiments, the composition comprises 0.1% to 0.2% by weight of the fumed silica based on the total weight of the composition.

In some embodiments, the fumed silica comprises at least one of a fumed silica powder, a modified fumed silica, a hydrophilic fumed silica, a hydrophobic fumed silica, or any combination thereof. In some embodiments, the fumed silica is after treated with dimethyldichlorosilane.

In some embodiments, the composition comprises at least one pigment.

In some embodiments, the composition comprises 1% to 20% by weight of the at least one pigment based on the total weight of the composition. In some embodiments, the composition comprises 2% to 20% by weight of the at least one pigment based on the total weight of the composition. In some embodiments, the composition comprises 4% to 20% by weight of the at least one pigment based on the total weight of the composition. In some embodiments, the composition comprises 5% to 20% by weight of the at least one pigment based on the total weight of the composition. In some embodiments, the composition comprises 6% to 20% by weight of the at least one pigment based on the total weight of the composition. In some embodiments, the composition comprises 8% to 20% by weight of the at least one pigment based on the total weight of the composition. In some embodiments, the composition comprises 10% to 20% by weight of the at least one pigment based on the total weight of the composition. In some embodiments, the composition comprises 12% to 20% by weight of the at least one pigment based on the total weight of the composition. In some embodiments, the composition comprises 14% to 20% by weight of the at least one pigment based on the total weight of the composition. In some embodiments, the composition comprises 15% to 20% by weight of the at least one pigment based on the total weight of the composition. In some embodiments, the composition comprises 16% to 20% by weight of the at least one pigment based on the total weight of the composition. In some embodiments, the composition comprises 18% to 20% by weight of the at least one pigment based on the total weight of the composition.

In some embodiments, the composition comprises 1% to 18% by weight of the at least one pigment based on the total weight of the composition. In some embodiments, the composition comprises 1% to 16% by weight of the at least one pigment based on the total weight of the composition. In some embodiments, the composition comprises 1% to 15% by weight of the at least one pigment based on the total weight of the composition. In some embodiments, the composition comprises 1% to 14% by weight of the at least one pigment based on the total weight of the composition. In some embodiments, the composition comprises 1% to 12% by weight of the at least one pigment based on the total weight of the composition. In some embodiments, the composition comprises 1% to 10% by weight of the at least one pigment based on the total weight of the composition. In some embodiments, the composition comprises 1% to 8% by weight of the at least one pigment based on the total weight of the composition. In some embodiments, the composition comprises 1% to 6% by weight of the at least one pigment based on the total weight of the composition. In some embodiments, the composition comprises 1% to 5% by weight of the at least one pigment based on the total weight of the composition. In some embodiments, the composition comprises 1% to 4% by weight of the at least one pigment based on the total weight of the composition. In some embodiments, the composition comprises 1% to 2% by weight of the at least one pigment based on the total weight of the composition.

In some embodiments, the at least one pigment comprises at least one of zinc oxide, antimony oxide, zirconium oxide, chromium oxide, iron oxide, lead oxide, zinc sulfide, titanium dioxide (anatase, rutile, or brookite), lithopone, and carbon black, or any combination thereof.

In some embodiments, the composition does not comprise the at least one pigment. In some embodiments, the composition, when cured, has a white appearance. In some embodiments, the composition does not comprise a white pigment.

In some embodiments, the composition comprises at least one crosslinker.

In some embodiments, the composition comprises 0.1% to 25% by weight of the at least one crosslinker based on the total weight of the composition. In some embodiments, the composition comprises 1% to 25% by weight of the at least one crosslinker based on the total weight of the composition. In some embodiments, the composition comprises 2% to 25% by weight of the at least one crosslinker based on the total weight of the composition. In some embodiments, the composition comprises 4% to 25% by weight of the at least one crosslinker based on the total weight of the composition. In some embodiments, the composition comprises 5% to 25% by weight of the at least one crosslinker based on the total weight of the composition. In some embodiments, the composition comprises 6% to 25% by weight of the at least one crosslinker based on the total weight of the composition. In some embodiments, the composition comprises 8% to 25% by weight of the at least one crosslinker based on the total weight of the composition. In some embodiments, the composition comprises 10% to 25% by weight of the at least one crosslinker based on the total weight of the composition. In some embodiments, the composition comprises 12% to 25% by weight of the at least one crosslinker based on the total weight of the composition. In some embodiments, the composition comprises 14% to 25% by weight of the at least one crosslinker based on the total weight of the composition. In some embodiments, the composition comprises 15% to 25% by weight of the at least one crosslinker based on the total weight of the composition. In some embodiments, the composition comprises 16% to 25% by weight of the at least one crosslinker based on the total weight of the composition. In some embodiments, the composition comprises 18% to 25% by weight of the at least one crosslinker based on the total weight of the composition. In some embodiments, the composition comprises 20% to 25% by weight of the at least one crosslinker based on the total weight of the composition. In some embodiments, the composition comprises 22% to 25% by weight of the at least one crosslinker based on the total weight of the composition. In some embodiments, the composition comprises 24% to 25% by weight of the at least one crosslinker based on the total weight of the composition.

In some embodiments, the composition comprises 0.1% to 24% by weight of the at least one crosslinker based on the total weight of the composition. In some embodiments, the composition comprises 0.1% to 22% by weight of the at least one crosslinker based on the total weight of the composition. In some embodiments, the composition comprises 0.1% to 20% by weight of the at least one crosslinker based on the total weight of the composition. In some embodiments, the composition comprises 0.1% to 18% by weight of the at least one crosslinker based on the total weight of the composition. In some embodiments, the composition comprises 0.1% to 16% by weight of the at least one crosslinker based on the total weight of the composition. In some embodiments, the composition comprises 0.1% to 15% by weight of the at least one crosslinker based on the total weight of the composition. In some embodiments, the composition comprises 0.1% to 14% by weight of the at least one crosslinker based on the total weight of the composition. In some embodiments, the composition comprises 0.1% to 12% by weight of the at least one crosslinker based on the total weight of the composition. In some embodiments, the composition comprises 0.1% to 10% by weight of the at least one crosslinker based on the total weight of the composition. In some embodiments, the composition comprises 0.1% to 9% by weight of the at least one crosslinker based on the total weight of the composition. In some embodiments, the composition comprises 0.1% to 8% by weight of the at least one crosslinker based on the total weight of the composition. In some embodiments, the composition comprises 0.1% to 7% by weight of the at least one crosslinker based on the total weight of the composition. In some embodiments, the composition comprises 0.1% to 6% by weight of the at least one crosslinker based on the total weight of the composition. In some embodiments, the composition comprises 0.1% to 5% by weight of the at least one crosslinker based on the total weight of the composition. In some embodiments, the composition comprises 0.1% to 4% by weight of the at least one crosslinker based on the total weight of the composition. In some embodiments, the composition comprises 0.1% to 3% by weight of the at least one crosslinker based on the total weight of the composition. In some embodiments, the composition comprises 0.1% to 2% by weight of the at least one crosslinker based on the total weight of the composition. In some embodiments, the composition comprises 0.1% to 1% by weight of the at least one crosslinker based on the total weight of the composition.

In some embodiments, the at least one crosslinker comprises a neutral curing agent. In some embodiments, the at least one crosslinker comprises at least one of ketoxime silanes, alkoxysilanes, acetoxysilanes, isopropenoxy silanes, a partial hydrolysate/condensate of said silanes, or any combination thereof. In some embodiments, the at least one crosslinker comprises an organosilane, which may contain at least 2 or at least 3 hydrolyzable groups in one molecule and/or its partial hydrolysate. In some embodiments, a hydrolyzable group in such an organosilane or its partial hydrolysate includes at least one of a ketoxime group, an alkoxy group, an acetoxy group, an isopropenoxy group, or any combination thereof. In some embodiments, the at least one crosslinker comprises an organic titanate, a thermal radical initiator, a UV radical initiator, or any combination thereof. In some embodiments, the at least one crosslinker comprises ketoxime silanes. In some embodiments, a ketoxime silane comprises at least one of tetrakis(methylethylketoxime) silane, methyltris(dimethylketoxime) silane, methyltris(methylethylketoxime) silane, ethyltris (methylethylketoxime) silane, methyltris(methyl isobutyl ketoxime) silane, vinyl tris(methylethylketoxime) silane or any combination thereof. In some embodiments, the at least one crosslinker comprises an alkoxysilane. In some embodiments, the alkoxysilane comprises at least one of methyltrimethoxysilane, vinyltrimethoxysilane, phenyltrimethoxysilane, vinyltriethoxy silane, or any combination thereof. In some embodiments, the at least one crosslinker comprises an acetoxysilane. In some embodiments, the acetoxysilane comprises at least one of methyltriacetoxysilane, vinyltriacetoxysilane, or any combination thereof. In some embodiments, the at least one crosslinker comprises an isopropenoxy silane. In some embodiments, the isopropenoxy silane comprises at least one of methyltriisopropenoxysilane, vinyltriisopropenoxysilane, phenyltriisopropenoxysilane, or any combination thereof. In some embodiments, the at least one crosslinker comprises a partial hydrolysate/condensate of any one of the silanes disclosed herein. In some embodiments, the at least one crosslinker comprises at least one of methyltris(methylethylketoxime) silane, vinyltris(methylethylketoxime) silane, or any combination thereof.

In some embodiments, the composition comprises at least one catalyst.

In some embodiments, the composition comprises 0.1% to 15% by weight of the at least one catalyst based on the total weight of the composition. In some embodiments, the composition comprises 0.5% to 15% by weight of the at least one catalyst based on the total weight of the composition. In some embodiments, the composition comprises 1% to 15% by weight of the at least one catalyst based on the total weight of the composition. In some embodiments, the composition comprises 2% to 15% by weight of the at least one catalyst based on the total weight of the composition. In some embodiments, the composition comprises 4% to 15% by weight of the at least one catalyst based on the total weight of the composition. In some embodiments, the composition comprises 5% to 15% by weight of the at least one catalyst based on the total weight of the composition. In some embodiments, the composition comprises 6% to 15% by weight of the at least one catalyst based on the total weight of the composition. In some embodiments, the composition comprises 8% to 15% by weight of the at least one catalyst based on the total weight of the composition. In some embodiments, the composition comprises 10% to 15% by weight of the at least one catalyst based on the total weight of the composition. In some embodiments, the composition comprises 12% to 15% by weight of the at least one catalyst based on the total weight of the composition. In some embodiments, the composition comprises 14% to 15% by weight of the at least one catalyst based on the total weight of the composition.

In some embodiments, the composition comprises 0.1% to 14% by weight of the at least one catalyst based on the total weight of the composition. In some embodiments, the composition comprises 0.1% to 12% by weight of the at least one catalyst based on the total weight of the composition. In some embodiments, the composition comprises 0.1% to 10% by weight of the at least one catalyst based on the total weight of the composition. In some embodiments, the composition comprises 0.1% to 8% by weight of the at least one catalyst based on the total weight of the composition. In some embodiments, the composition comprises 0.1% to 6% by weight of the at least one catalyst based on the total weight of the composition. In some embodiments, the composition comprises 0.1% to 5% by weight of the at least one catalyst based on the total weight of the composition. In some embodiments, the composition comprises 0.1% to 4% by weight of the at least one catalyst based on the total weight of the composition. In some embodiments, the composition comprises 0.1% to 2% by weight of the at least one catalyst based on the total weight of the composition. In some embodiments, the composition comprises 0.1% to 1% by weight of the at least one catalyst based on the total weight of the composition. In some embodiments, the composition comprises 0.1% to 0.8% by weight of the at least one catalyst based on the total weight of the composition. In some embodiments, the composition comprises 0.1% to 0.6% by weight of the at least one catalyst based on the total weight of the composition. In some embodiments, the composition comprises 0.1% to 0.5% by weight of the at least one catalyst based on the total weight of the composition. In some embodiments, the composition comprises 0.1% to 0.4% by weight of the at least one catalyst based on the total weight of the composition. In some embodiments, the composition comprises 0.1% to 0.2% by weight of the at least one catalyst based on the total weight of the composition.

In some embodiments, the at least one catalyst comprises at least one of an organic tin, an organic platinum, triethanolamine titanate, dimethyltin dioleate, dibutyltin diacetate, stannous octoate, dibutyltin dioctoate, dibutyltin dilaurate, dibutyltin dimethoxide, dibutyltin bis(acetylacetonate), dibutyltin bis(benzylmalate), dimethyltin dimethoxide, dimethyltin diacetate, dioctyltin dioctate, dioctyltin dilaurate, tin dioctate, tin laurate, tetraisopropyl titanate, tetra-n-butyl titanate, tetra-tertiary butyl titanate, tetra-n-propyl titanate, tetra-2-ethylhexyl titanate, diisopropyl di-tertiary butyl titanate, dimethoxy titanium bisacetylacetonate, diisopropoxy titanium bisethyl acetoacetate, di-tertiary butoxy titanium bisethyl acetoacetate, di-tertiary butoxy titanium bismethyl acetoacetate, or any combination thereof.

In some embodiments, the composition comprises at least one adhesion promoter.

In some embodiments, the composition comprises 0.1% to 20% by weight of the at least one adhesion promoter based on the total weight of the composition. In some embodiments, the composition comprises 0.5% to 20% by weight of the at least one adhesion promoter based on the total weight of the composition. In some embodiments, the composition comprises 1% to 20% by weight of the at least one adhesion promoter based on the total weight of the composition. In some embodiments, the composition comprises 2% to 20% by weight of the at least one adhesion promoter based on the total weight of the composition. In some embodiments, the composition comprises 4% to 20% by weight of the at least one adhesion promoter based on the total weight of the composition. In some embodiments, the composition comprises 5% to 20% by weight of the at least one adhesion promoter based on the total weight of the composition. In some embodiments, the composition comprises 6% to 20% by weight of the at least one adhesion promoter based on the total weight of the composition. In some embodiments, the composition comprises 8% to 20% by weight of the at least one adhesion promoter based on the total weight of the composition. In some embodiments, the composition comprises 10% to 20% by weight of the at least one adhesion promoter based on the total weight of the composition. In some embodiments, the composition comprises 12% to 20% by weight of the at least one adhesion promoter based on the total weight of the composition. In some embodiments, the composition comprises 14% to 20% by weight of the at least one adhesion promoter based on the total weight of the composition. In some embodiments, the composition comprises 15% to 20% by weight of the at least one adhesion promoter based on the total weight of the composition. In some embodiments, the composition comprises 16% to 20% by weight of the at least one adhesion promoter based on the total weight of the composition. In some embodiments, the composition comprises 18% to 20% by weight of the at least one adhesion promoter based on the total weight of the composition.

In some embodiments, the composition comprises 0.1% to 18% by weight of the at least one adhesion promoter based on the total weight of the composition. In some embodiments, the composition comprises 0.1% to 16% by weight of the at least one adhesion promoter based on the total weight of the composition. In some embodiments, the composition comprises 0.1% to 15% by weight of the at least one adhesion promoter based on the total weight of the composition. In some embodiments, the composition comprises 0.1% to 14% by weight of the at least one adhesion promoter based on the total weight of the composition. In some embodiments, the composition comprises 0.1% to 12% by weight of the at least one adhesion promoter based on the total weight of the composition. In some embodiments, the composition comprises 0.1% to 10% by weight of the at least one adhesion promoter based on the total weight of the composition. In some embodiments, the composition comprises 0.1% to 8% by weight of the at least one adhesion promoter based on the total weight of the composition. In some embodiments, the composition comprises 0.1% to 6% by weight of the at least one adhesion promoter based on the total weight of the composition. In some embodiments, the composition comprises 0.1% to 5% by weight of the at least one adhesion promoter based on the total weight of the composition. In some embodiments, the composition comprises 0.1% to 4% by weight of the at least one adhesion promoter based on the total weight of the composition. In some embodiments, the composition comprises 0.1% to 2% by weight of the at least one adhesion promoter based on the total weight of the composition. In some embodiments, the composition comprises 0.1% to 1% by weight of the at least one adhesion promoter based on the total weight of the composition. In some embodiments, the composition comprises 0.1% to 0.8% by weight of the at least one adhesion promoter based on the total weight of the composition. In some embodiments, the composition comprises 0.1% to 0.6% by weight of the at least one adhesion promoter based on the total weight of the composition. In some embodiments, the composition comprises 0.1% to 0.5% by weight of the at least one adhesion promoter based on the total weight of the composition. In some embodiments, the composition comprises 0.1% to 0.4% by weight of the at least one adhesion promoter based on the total weight of the composition. In some embodiments, the composition comprises 0.1% to 0.2% by weight of the at least one adhesion promoter based on the total weight of the composition.

In some embodiments, the at least one adhesion promoter comprises at least one of dichlorodimethyl silane, a chlorinated polyolefin, an organosilane, an organotitanate, a zircoaluminate, a zirconate, an acrylate, an aryl phosphate ester, an alkyl phosphate ester, an aryl alkyl phosphate ester, a metal organic, a silica, a fumed silica, N-(2-aminoethyl)-3-aminopropyltrimethoxysilane, vinyl tris(2-methoxyethoxy) silane, 3-methacryloxypropyltrimethoxysilane, 2-(3,4-epoxycyclohexyl)ethyl trimethoxysilane, 3-glycidoxypropyltrimethoxysilane, 3-glycidoxypropylmethyldiethoxysilane, N-(2-aminoethyl) 3-aminopropyltrimethoxysilane, 3-aminopropyltriethoxysilane, 3-(N-aminomethylbenzylamino) propyltrimethoxysilane, 3-mercaptopropyltrimethoxysilane, 3-aminopropyltris (methylethylketoxime) silane, 3-glycidoxy propyltriisopropenoxysilane, 3-glycidoxypropylmethyldiisopropenoxysilane, any reaction product thereof, or any combination thereof. In some embodiments, the adhesion promoter is a reaction product of dichlorodimethylsilane and a silica agent. In some embodiments, the silica agent comprises a fumed silica. In some embodiments, the at least one adhesion promoter comprises at least one of tetraethyl orthosilicate, aminopropyltrimethoxysilane, or any combination thereof.

In some embodiments, the composition is provided in a form of a solid composition. In some embodiments, the composition is provided in a form of a liquid composition. In some embodiments, the composition is provided in a form of a solution. In some embodiments, the composition is provided in a form of an aqueous solution. In some embodiments, the composition comprises at least one solvent. In some embodiments, the solvent comprises at least one of a water, an organic solvent, or any combination thereof.

Some embodiments relate to a kit. In some embodiments, the kit comprises a container. In some embodiments, the container comprises a composition, such as, for example and without limitation, any of the compositions disclosed herein. In some embodiments, the container comprises a sealable enclosure. In some embodiments, the container comprises a bucket. In some embodiments, the container comprises a lid top. In some embodiments, the container comprises a screw top. In some embodiments, the container comprises a pressable top (e.g., a paint-can top). In some embodiments, the container comprises a cartridge for a caulk gun. In some embodiments, the container comprises a sealed bag. In some embodiments, the container comprises a sealable bag.

In some embodiments, the container has a volume of 1 gallon to 10 gallons. In some embodiments, the container has a volume of 1 gallon to 9 gallons. In some embodiments, the container has a volume of 1 gallon to 8 gallons. In some embodiments, the container has a volume of 1 gallon to 7 gallons. In some embodiments, the container has a volume of 1 gallon to 6 gallons. In some embodiments, the container has a volume of 1 gallon to 5 gallons. In some embodiments, the container has a volume of 1 gallon to 4 gallons. In some embodiments, the container has a volume of 1 gallon to 3 gallons. In some embodiments, the container has a volume of 1 gallon to 2 gallons. In some embodiments, the container has a volume of 2 gallon to 10 gallons. In some embodiments, the container has a volume of 3 gallon to 10 gallons. In some embodiments, the container has a volume of 4 gallon to 10 gallons. In some embodiments, the container has a volume of 5 gallon to 10 gallons. In some embodiments, the container has a volume of 6 gallon to 10 gallons. In some embodiments, the container has a volume of 7 gallon to 10 gallons. In some embodiments, the container has a volume of 8 gallon to 10 gallons. In some embodiments, the container has a volume of 9 gallon to 10 gallons. In some embodiments, the container has a volume of 4 gallon to 6 gallons. In some embodiments, the container has a volume of 5 gallons. In some embodiments, the container has a volume of 1 gallon. In some embodiments, the container has a volume of 0.5 gallons to 1 gallon.

In some embodiments, the container has a volume of 5 fluid ounces to 15 fluid ounces. In some embodiments, the container has a volume of 5 fluid ounces to 14 fluid ounces. In some embodiments, the container has a volume of 5 fluid ounces to 13 fluid ounces. In some embodiments, the container has a volume of 5 fluid ounces to 12 fluid ounces. In some embodiments, the container has a volume of 5 fluid ounces to 11 fluid ounces. In some embodiments, the container has a volume of 5 fluid ounces to 10 fluid ounces. In some embodiments, the container has a volume of 5 fluid ounces to 9 fluid ounces. In some embodiments, the container has a volume of 5 fluid ounces to 8 fluid ounces. In some embodiments, the container has a volume of 5 fluid ounces to 7 fluid ounces. In some embodiments, the container has a volume of 5 fluid ounces to 6 fluid ounces.

In some embodiments, the container has a volume of 6 fluid ounces to 15 fluid ounces. In some embodiments, the container has a volume of 7 fluid ounces to 15 fluid ounces. In some embodiments, the container has a volume of 8 fluid ounces to 15 fluid ounces. In some embodiments, the container has a volume of 9 fluid ounces to 15 fluid ounces. In some embodiments, the container has a volume of 10 fluid ounces to 15 fluid ounces. In some embodiments, the container has a volume of 11 fluid ounces to 15 fluid ounces. In some embodiments, the container has a volume of 12 fluid ounces to 15 fluid ounces. In some embodiments, the container has a volume of 13 fluid ounces to 15 fluid ounces. In some embodiments, the container has a volume of 14 fluid ounces to 15 fluid ounces. In some embodiments, the container has a volume of 9 fluid ounces to 11 fluid ounces. In some embodiments, the container has a volume of 10 fluid ounces.

In some embodiments, the kit comprises a roller device. In some embodiments, the roller device comprises a roller. In some embodiments, the roller device comprises a handle attached to a roller. In some embodiments, the roller device comprises a paint roller frame. In some embodiments, the roller device comprises a nap. In some embodiments, the roller comprises a magnetic array. In some embodiments, the roller comprises a hollow cylindrical body, and the magnetic array is located on an inner surface of the hollow cylindrical body. In some embodiments, the roller comprises a hollow spherical body, and the magnetic array is located on an inner surface of the hollow spherical body. In some embodiments, the magnetic array is secured to the inner surface. In some embodiments, the magnetic array is mechanically fastened to the inner surface. In some embodiments, the magnetic array is adhered to the inner surface. In some embodiments, the magnetic array is bonded to the inner surface.

In some embodiments, the magnetic array comprises at least one magnet. In some embodiments, the magnetic array comprises a plurality of magnets. In some embodiments, the magnetic array comprises 1 magnets to 100 magnets. In some embodiments, for example, the magnetic array comprises at least one of a first magnet, a second magnet, a third magnet, a fourth magnet, a fifth magnet, a sixth magnet, a seventh magnet, an eighth magnet, a ninth magnet, a tenth magnet, up to 100 or more magnets, or any combination thereof.

In some embodiments, the magnetic array is configured to apply a magnetic field. In some embodiments, the magnetic array is configured to apply a directional magnetic field. In some embodiments, a directional magnetic field refers to a direction of a magnetic force applied by the magnetic array. In some embodiments, a directional magnetic field refers to a generalized direction of the magnetic force applied by the magnetic array. In some embodiments, a directional magnetic field refers to a localized direction of a magnetic force applied by the magnetic array. In some embodiments, the directional magnetic field is a horizontal magnetic field. In some embodiments, the horizontal magnetic field is perpendicular to a direction of rolling. In some embodiments, for example, the magnetic field is applied in a horizontal direction when the applied magnetic field that is effective to induce a response to an orientation and/or alignment of the magnetic-responsive additive is applied in a direction that is perpendicular to the direction of rolling. In some embodiments, the magnetic array comprises at least one Halbach array of magnetics. As used herein, the term "Halbach array" refers to an arrangement of magnetics in which one side of the arrangement of magnetics (e.g., permanent magnets) has a stronger magnetic field than another side of the arrangement of magnetics. In some embodiments, the at least one Halbach array of magnetics comprises at least one circular Halbach array of magnetics oriented about a central axis of the roller. In some embodiments, the magnetic array comprises a Halbach cylinder array. In some embodiments, the magnetic array comprises a Halbach sphere. In some embodiments, the magnetic array comprises a Halbach array, wherein the Halbach array is a variable linear array. In some embodiments, the magnetic array comprises a linear (planar) Halbach array. In some embodiments, the magnetic array comprises magnetics arranged in a Halbach array such that the magnetic field (e.g., the side with the stronger magnetic field) is directed outwards from the roller (e.g., directed outside the hollow cylindrical body). In some embodiments, the magnetic array comprises magnetics arranged in a Halbach array such that the magnetic field (e.g., the side with the stronger magnetic field) is directed outwards from a central axis of a cylindrical roller.

In some embodiments, when the composition is spread by the roller device on a roofing substrate, the magnetic array is configured to apply a directional magnetic field to the magnetic-responsive additive present in the composition. In some embodiments, when the composition is spread by the roller device on a roofing substrate in a presence of a magnetic field and the composition is cured, at least a portion of the magnetic-responsive additive is aligned in a horizontal orientation. As used herein, the term "aligned in a horizontal direction" refers to an orientation of the magnetically-responsive additive in which a major surface of the magnetic-responsive additive is more parallel to a horizontal plane than to a vertical plane, wherein the horizontal plane is defined by a surface on which the composition is located. In some embodiments, when the composition is spread by the roller device on a roofing substrate and when the composition is cured, the magnetic-responsive additive is aligned in an orientation sufficient to result in a cured composition having a reflectivity that is at least two times greater than a reflectivity of a cured control composition, wherein the cured control composition is a composition that does not comprise the magnetic-responsive additive and/or a composition that is not subjected to a magnetic field (e.g., a magnetic field sufficient to orient the magnetic-responsive additive, optionally in a predetermined direction) sufficient to increase a reflectivity of the cured control composition. In some embodiments, a sufficient amount of the magnetic-responsive additive is magnetically aligned, by the magnetic array, in the horizontal orientation, so as to result in a cured composition having a reflectivity that is at least two times greater than a reflectivity of a cured silicon-containing membrane which does not comprise the magnetic-responsive additive.

In some embodiments, 1% to 99% of the magnetic-responsive additive is magnetically aligned in the horizontal direction. In some embodiments, 1% to 90% of the magnetic-responsive additive is magnetically aligned in the horizontal direction. In some embodiments, 1% to 80% of the magnetic-responsive additive is magnetically aligned in the horizontal direction. In some embodiments, 1% to 70% of the magnetic-responsive additive is magnetically aligned in the horizontal direction. In some embodiments, 1% to 60% of the magnetic-responsive additive is magnetically aligned in the horizontal direction. In some embodiments, 1% to 50% of the magnetic-responsive additive is magnetically aligned in the horizontal direction. In some embodiments, 1% to 40% of the magnetic-responsive additive is magnetically aligned in the horizontal direction. In some embodiments, 1% to 30% of the magnetic-responsive additive is magnetically aligned in the horizontal direction. In some embodiments, 1% to 20% of the magnetic-responsive additive is magnetically aligned in the horizontal direction. In some embodiments, 1% to 10% of the magnetic-responsive additive is magnetically aligned in the horizontal direction.

In some embodiments, 10% to 99% of the magnetic-responsive additive is magnetically aligned in the horizontal direction. In some embodiments, 20% to 99% of the magnetic-responsive additive is magnetically aligned in the horizontal direction. In some embodiments, 30% to 99% of the magnetic-responsive additive is magnetically aligned in the horizontal direction. In some embodiments, 40% to 99% of the magnetic-responsive additive is magnetically aligned in the horizontal direction. In some embodiments, 50% to 99% of the magnetic-responsive additive is magnetically aligned in the horizontal direction. In some embodiments, 60% to 99% of the magnetic-responsive additive is magnetically aligned in the horizontal direction. In some embodiments, 70% to 99% of the magnetic-responsive additive is magnetically aligned in the horizontal direction. In some embodiments, 80% to 99% of the magnetic-responsive additive is magnetically aligned in the horizontal direction. In some embodiments, 90% to 99% of the magnetic-responsive additive is magnetically aligned in the horizontal direction. In some embodiments, 95% to 99% of the magnetic-responsive additive is magnetically aligned in the horizontal direction. In some embodiments, a percentage of the magnetic-responsive additive that is aligned in the horizontal direction is based on a sampling of the composition and/or cured composition as determined by a visual inspection of an optical microscope image of a cross-section of the composition and/or cured composition.

In some embodiments, a percentage of the magnetic-responsive additive having a similar orientation (e.g., alignment in a horizontal direction) in the cured composition is uniform or substantially uniform as determined by a visual inspection of a surface of the cured composition. In some embodiments, the percentage of the magnetic-responsive additive having a similar orientation is uniform or substantially uniform when no pattern is observed when the cured composition is visually inspected. In some embodiments, cured composition has a uniform or substantially uniform distribution of the magnetic-responsive additive in a horizontal orientation when the cured composition has a white appearance or substantially white appearance based on a visual inspection—i.e., darker regions are not observed, which may indicate regions of vertically aligned magnetic-responsive additive, whereas lighter regions (or white appearing regions) may indicate regions of horizontally aligned magnetic-responsive additive. In some embodiments, when the magnetic-responsive additive has a uniform or substantially uniform orientation in the cured composition, the cured composition has an even distribution of magnetic-responsive additives aligned in a horizontal direction and/or in a vertical direction.

FIG. 1 is a flowchart of a method 100 for installing a roofing material, according to some embodiments. As shown in FIG. 1, the method 100 of installing a roofing material comprises one or more of the following steps: obtaining 102 a composition; obtaining 104 a roller device; contacting 106 the roller device with the composition; and curing 108 the composition, so as to obtain a roofing material. In some embodiments, the method 100 of installing a roofing material comprises obtaining a kit, wherein the step of obtaining the kit comprises obtaining 102 the composition and obtaining 104 the roller device.

At step 102, in some embodiments, the method 100 of installing a roofing material comprises obtaining a composition. In some embodiments, the composition may comprise any of the compositions disclosed herein. For example, in some embodiments, the composition comprises a polymer, wherein the polymer comprises at least one of a polysiloxane, a silyl-terminated polymer, or any combination thereof. In some embodiments, the composition comprises a magnetic-responsive additive. For example, in some embodiments, the composition comprises 1% to 20% by weight of the magnetic-responsive additive based on a total weight of the composition. It will be appreciated that any of the compositions disclosed herein may be used without departing from the scope of this disclosure.

At step 104, in some embodiments, the method 100 of installing a roofing material comprises obtaining a roller device. In some embodiments, the roller device may comprise any of the roller devices disclosed herein. For example, in some embodiments, the roller device comprises a roller. In some embodiments, the roller comprises a magnetic array. In some embodiments, the magnetic array is configured to apply a magnetic field. In some embodiments, the magnetic array is configured to apply a directional magnetic field. In some embodiments, when the composition is spread, by the roller device, on a roofing substrate and when the composition is cured, at least a portion of the magnetic-responsive additive is aligned in a horizontal direction. It will be appreciated that any of the roller devices disclosed herein may be used without departing from the scope of this disclosure.

At step 106, in some embodiments, the method 100 of installing a roofing material comprises contacting the roller device with the composition. In some embodiments, the contacting comprises spreading the composition onto at least a portion of a surface of a roofing substrate. In some embodiments, the contacting comprises applying the composition onto at least a portion of a surface of a roofing substrate. In some embodiments, the contacting comprises at least partially immersing the roller in the composition. In some embodiments, the contacting comprises rolling the composition onto at least a portion of a surface of a roofing substrate. In some embodiments, the contacting comprises brushing the composition onto at least a portion of a surface of a roofing substrate. In some embodiments, the contacting comprises applying a magnetic field, optionally while spreading, applying, or rolling the composition. In some embodiments, the contacting comprises applying a directional magnetic field, optionally while spreading, applying, or rolling the composition. In some embodiments, the contacting comprises magnetically aligning at least a portion of the magnetic-responsive additive in a horizontal direction. In some embodiments, before the contacting step, applying the silicon-containing composition to the roller of the roller device. In some embodiments, before the contacting step, applying the silicon-containing composition to the surface of the roofing substrate. In some embodiments, the magnetic field is applied before the composition is fully cured, substantially cured, and/or partially cured.

In some embodiments, the roofing substrate comprises at least one of an asphaltic substrate, a plywood substrate, a glass substrate, a cellulosic substrate, an underlayment, a roofing membrane (reinforced or unreinforced), a roof deck, a photovoltaic (PV) panel, a modified bitumen (MODBIT) substrate, an oriented strand board (OSB), a roll good, a board (such as but not limited to at least one of a foam board (e.g., a polyisocyanurate (ISO) foam board), a cover board, or any combination thereof), a fire retardant board, a hail resistant board, a high density cover board, a cement board, concrete, a base sheet, a pipe, a chimney, a wax paper, a roof shingle, a mat, a fabric, a glass mat, a fiberglass mat, a woven mat, a nonwoven a fabric, a polyester mat, a scrim, a coated scrim, or any combination thereof.

At step 108, in some embodiments, the method 100 of installing a roofing material comprises curing the composition, so as to obtain a roofing material. In some embodiments, the curing comprises exposing the composition to ambient conditions for a duration sufficient to at least partially cure the composition. In some embodiments, the curing comprises heating the composition to a temperature sufficient to at least partially cure the composition. In some embodiments, the curing comprises exposing the composition to water moisture sufficient to at least partially cure the composition. In some embodiments, the curing comprises exposing the composition to light (e.g., ultraviolet light, visible light, infrared light, etc.) sufficient to at least partially cure the composition. In some embodiments, the curing comprises applying a stimulus or stimuli sufficient to induce curing. In some embodiments, the curing proceeds under conditions sufficient to at least partially cure the composition. In some embodiments, the curing proceeds under conditions sufficient to at least substantially cure the composition. In some embodiments, the curing proceeds under conditions sufficient to fully cure the composition. In some embodiments, the curing is sufficient to obtain a roofing material (e.g., a roofing membrane, etc.).

In some embodiments, the cured composition has a thickness of 1 mil to 200 mils. In some embodiments, the cured composition has a thickness of 1 mil to 190 mils. In some embodiments, the cured composition has a thickness of 1 mil to 180 mils. In some embodiments, the cured composition has a thickness of 1 mil to 170 mils. In some embodiments, the cured composition has a thickness of 1 mil to 160 mils. In some embodiments, the cured composition has a thickness of 1 mil to 150 mils. In some embodiments, the cured composition has a thickness of 1 mil to 140 mils. In some embodiments, the cured composition has a thickness of 1 mil to 130 mils. In some embodiments, the cured composition has a thickness of 1 mil to 120 mils. In some embodiments, the cured composition has a thickness of 1 mil to 110 mils. In some embodiments, the cured composition has a thickness of 1 mil to 100 mils. In some embodiments, the cured composition has a thickness of 1 mil to 90 mils. In some embodiments, the cured composition has a thickness of 1 mil to 80 mils. In some embodiments, the cured composition has a thickness of 1 mil to 70 mils. In some embodiments, the cured composition has a thickness of 1 mil to 60 mils. In some embodiments, the cured composition has a thickness of 1 mil to 50 mils. In some embodiments, the cured composition has a thickness of 1 mil to 40 mils. In some embodiments, the cured composition has a thickness of 1 mil to 30 mils. In some embodiments, the cured composition has a thickness of 1 mil to 20 mils. In some embodiments, the cured composition has a thickness of 1 mil to 10 mils. In some embodiments, the cured composition has a thickness of 1 mil to 5 mils.

In some embodiments, the cured composition has a thickness of 5 mils to 200 mils. In some embodiments, the cured composition has a thickness of 10 mils to 200 mils. In some embodiments, the cured composition has a thickness of 20 mils to 200 mils. In some embodiments, the cured composition has a thickness of 30 mils to 200 mils. In some embodiments, the cured composition has a thickness of 40 mils to 200 mils. In some embodiments, the cured composition has a thickness of 50 mils to 200 mils. In some embodiments, the cured composition has a thickness of 60 mils to 200 mils. In some embodiments, the cured composition has a thickness of 70 mils to 200 mils. In some embodiments, the cured composition has a thickness of 80 mils to 200 mils. In some embodiments, the cured composition has a thickness of 90 mils to 200 mils. In some embodiments, the cured composition has a thickness of 100 mils to 200 mils. In some embodiments, the cured composition has a thickness of 110 mils to 200 mils. In some embodiments, the cured composition has a thickness of 120 mils to 200 mils. In some embodiments, the cured composition has a thickness of 130 mils to 200 mils. In some embodiments, the cured composition has a thickness of 140 mils to 200 mils. In some embodiments, the cured composition has a thickness of 150 mils to 200 mils. In some embodiments, the cured composition has a thickness of 160 mils to 200 mils. In some embodiments, the cured composition has a thickness of 170 mils to 200 mils. In some embodiments, the cured composition has a thickness of 180 mils to 200 mils. In some embodiments, the cured composition has a thickness of 190 mils to 200 mils.

In some embodiments, the curing is performed at a temperature of 20° C. to 400° C. In some embodiments, the curing is performed at a temperature of 25° C. to 400° C. In some embodiments, the curing is performed at a temperature of 30° C. to 400° C. In some embodiments, the curing is performed at a temperature of 35° C. to 400° C. In some embodiments, the curing is performed at a temperature of 40° C. to 400° C. In some embodiments, the curing is performed at a temperature of 45° C. to 400° C. In some embodiments, the curing is performed at a temperature of 50° C. to 400° C. In some embodiments, the curing is performed at a temperature of 75° C. to 400° C. In some embodiments, the curing is performed at a temperature of 100° C. to 400° C. In some embodiments, the curing is performed at a temperature of 125° C. to 400° C. In some embodiments, the curing is performed at a temperature of 150° C. to 400° C. In some embodiments, the curing is performed at a temperature of 175° C. to 400° C. In some embodiments, the curing is performed at a temperature of 200° C. to 400° C. In some embodiments, the curing is performed at a temperature of 225° C. to 400° C. In some embodiments, the curing is performed at a temperature of 250° C. to 400° C. In some embodiments, the curing is performed at a temperature of 275° C. to 400° C. In some embodiments, the curing is performed at a temperature of 300° C. to 400° C. In some embodiments, the curing is performed at a temperature of 325° C. to 400° C. In some embodiments, the curing is performed at a temperature of 350° C. to 400° C. In some embodiments, the curing is performed at a temperature of 375° C. to 400° C.

In some embodiments, the curing is performed at a temperature of 20° C. to 375° C. In some embodiments, the curing is performed at a temperature of 20° C. to 350° C. In some embodiments, the curing is performed at a temperature of 20° C. to 325° C. In some embodiments, the curing is performed at a temperature of 20° C. to 300° C. In some embodiments, the curing is performed at a temperature of 20° C. to 275° C. In some embodiments, the curing is performed at a temperature of 20° C. to 250° C. In some embodiments, the curing is performed at a temperature of 20° C. to 225° C. In some embodiments, the curing is performed at a temperature of 20° C. to 200° C. In some embodiments, the curing is performed at a temperature of 20° C. to 175° C. In some embodiments, the curing is performed at a temperature of 20° C. to 150° C. In some embodiments, the curing is performed at a temperature of 20° C. to 125° C. In some embodiments, the curing is performed at a temperature of 20° C. to 100° C. In some embodiments, the curing is performed at a temperature of 20° C. to 75° C. In some embodiments, the curing is performed at a temperature of 20° C. to 50° C. In some embodiments, the curing is performed at a temperature of 20° C. to 45° C. In some embodiments, the curing is performed at a temperature of 20° C. to 40° C. In some embodiments, the curing is performed at a temperature of 20° C. to 35° C. In some embodiments, the curing is performed at a temperature of 20° C. to 30° C. In some embodiments, the curing is performed at a temperature of 20° C. to 25° C.

In some embodiments, the cured composition has a thickness of 10 mils to 500 mils. In some embodiments, the cured composition has a thickness of 10 mils to 475 mils. In some embodiments, the cured composition has a thickness of 10 mils to 450 mils. In some embodiments, the cured composition has a thickness of 10 mils to 425 mils. In some embodiments, the cured composition has a thickness of 10 mils to 400 mils. In some embodiments, the cured composition has a thickness of 10 mils to 375 mils. In some embodiments, the cured composition has a thickness of 10 mils to 350 mils. In some embodiments, the cured composition has a thickness of 10 mils to 325 mils. In some embodiments, the cured composition has a thickness of 10 mils to 300 mils. In some embodiments, the cured composition has a thickness of 10 mils to 275 mils. In some embodiments, the cured composition has a thickness of 10 mils to 250 mils. In some embodiments, the cured composition has a thickness of 10 mils to 225 mils. In some embodiments, the cured composition has a thickness of 10 mils to 200 mils. In some embodiments, the cured composition has a thickness of 10 mils to 175 mils. In some embodiments, the cured composition has a thickness of 10 mils to 150 mils. In some embodiments, the cured composition has a thickness of 10 mils to 125 mils. In some embodiments, the cured composition has a thickness of 10 mils to 100 mils. In some embodiments, the cured composition has a thickness of 10 mils to 75 mils. In some embodiments, the cured composition has a thickness of 10 mils to 50 mils. In some embodiments, the cured composition has a thickness of 10 mils to 25 mils.

In some embodiments, the cured composition has a thickness of 25 mils to 500 mils. In some embodiments, the cured composition has a thickness of 50 mils to 500 mils. In some embodiments, the cured composition has a thickness of 75 mils to 500 mils. In some embodiments, the cured composition has a thickness of 100 mils to 500 mils. In some embodiments, the cured composition has a thickness of 125 mils to 500 mils. In some embodiments, the cured composition has a thickness of 150 mils to 500 mils. In some embodiments, the cured composition has a thickness of 175 mils to 500 mils. In some embodiments, the cured composition has a thickness of 200 mils to 500 mils. In some embodiments, the cured composition has a thickness of 225 mils to 500 mils. In some embodiments, the cured composition has a thickness of 250 mils to 500 mils. In some embodiments, the cured composition has a thickness of 275 mils to 500 mils. In some embodiments, the cured composition has a thickness of 300 mils to 500 mils. In some embodiments, the cured composition has a thickness of 325 mils to 500 mils. In some embodiments, the cured composition has a thickness of 350 mils to 500 mils. In some embodiments, the cured composition has a thickness of 375 mils to 500 mils. In some embodiments, the cured composition has a thickness of 400 mils to 500 mils. In some embodiments, the cured composition has a thickness of 425 mils to 500 mils. In some embodiments, the cured composition has a thickness of 450 mils to 500 mils. In some embodiments, the cured composition has a thickness of 475 mils to 500 mils.

Some embodiments relate to a roofing system. In some embodiments, the roofing system comprises a roofing substrate. In some embodiments, the roofing substrate comprises at least one of an asphaltic substrate, a plywood substrate, a glass substrate, a cellulosic substrate, an underlayment, a roofing membrane (reinforced or unreinforced), a roof deck, a photovoltaic (PV) panel, a modified bitumen (MODBIT) substrate, an oriented strand board (OSB), a roll good, a board (such as but not limited to at least one of a foam board (e.g., a polyisocyanurate (ISO) foam board), a cover board, or any combination thereof), a fire retardant board, a hail resistant board, a building structure, a high density cover board, a cement board, concrete, a base sheet, a pipe, a chimney, a wax paper, a roof shingle, a mat, a fabric, a glass mat, a fiberglass mat, a woven mat, a nonwoven a fabric, a polyester mat, a scrim, a coated scrim, or any combination thereof.

In some embodiments, the roofing system comprises a cured composition. In some embodiments, the cured composition comprises any of the cured compositions disclosed herein. In some embodiments, the cured composition is a roofing material. In some embodiments, the cured composition is located on the roofing substrate. In some embodiments, the cured composition covers at least a first portion of the roofing substrate. In some embodiments, the cured composition is installed on the roofing substrate. In some embodiments, the cured composition is secured to the roofing substrate. In some embodiments, the cured composition is fastened to the roofing substrate by at least one mechanical fastener. In some embodiments, the cured composition is nailed to the roofing substrate. In some embodiments, the cured composition is adhered to the roofing substrate (e.g., by an adhesive layer). In some embodiments, the cured composition is bonded to the roofing substrate. In some embodiments, the cured composition directly contacts the roofing substrate. In some embodiments, an intervening layer is located between the cured composition and the roofing substrate.

In some embodiments, the cured composition has a reflectivity that is at least two times greater than a reflectivity of a cured control composition. In some embodiments, an increase in the reflectivity of the cured composition, relative to the cured control composition, is proportional to the amount of the magnetic-responsive additive aligned in a horizontal direction. In some embodiments, the increase in reflectivity of the cured composition is achieved without, or in the absence of, any white pigment, or with a negligible amount of white pigment, added to the composition. In some embodiments, the cured composition has a reflectivity that is 2 to 50 times greater than a reflectivity of the cured control composition. In some embodiments, the cured composition has a reflectivity that is 3 to 50 times greater than a reflectivity of the cured control composition. In some embodiments, the cured composition has a reflectivity that is 4 to 50 times greater than a reflectivity of the cured control composition. In some embodiments, the cured composition has a reflectivity that is 5 to 50 times greater than a reflectivity of the cured control composition. In some embodiments, the cured composition has a reflectivity that is 6 to 50 times greater than a reflectivity of the cured control composition. In some embodiments, the cured composition has a reflectivity that is 7 to 50 times greater than a reflectivity of the cured control composition. In some embodiments, the cured composition has a reflectivity that is 8 to 50 times greater than a reflectivity of the cured control composition. In some embodiments, the cured composition has a reflectivity that is 9 to 50 times greater than a reflectivity of the cured control composition. In some embodiments, the cured composition has a reflectivity that is 10 to 50 times greater than a reflectivity of the cured control composition. In some embodiments, the cured composition has a reflectivity that is 20 to 50 times greater than a reflectivity of the cured control composition. In some embodiments, the cured composition has a reflectivity that is 30 to 50 times greater than a reflectivity of the cured control composition. In some embodiments, the cured composition has a reflectivity that is 40 to 50 times greater than a reflectivity of the cured control composition.

In some embodiments, the cured composition has a reflectivity that is 2 to 40 times greater than a reflectivity of the cured control composition. In some embodiments, the cured composition has a reflectivity that is 2 to 30 times greater than a reflectivity of the cured control composition. In some embodiments, the cured composition has a reflectivity that is 2 to 20 times greater than a reflectivity of the cured control composition. In some embodiments, the cured composition has a reflectivity that is 2 to 10 times greater than a reflectivity of the cured control composition. In some embodiments, the cured composition has a reflectivity that is 2 to 9 times greater than a reflectivity of the cured control composition. In some embodiments, the cured composition has a reflectivity that is 2 to 8 times greater than a reflectivity of the cured control composition. In some embodiments, the cured composition has a reflectivity that is 2 to 7 times greater than a reflectivity of the cured control composition. In some embodiments, the cured composition has a reflectivity that is 2 to 6 times greater than a reflectivity of the cured control composition. In some embodiments, the cured composition has a reflectivity that is 2 to 5 times greater than a reflectivity of the cured control composition. In some embodiments, the cured composition has a reflectivity that is 2 to 4 times greater than a reflectivity of the cured control composition. In some embodiments, the cured composition has a reflectivity that is 2 to 3 times greater than a reflectivity of the cured control composition.

Some embodiments relate to a roofing membrane. It will be appreciated that any one or more of the roofing membranes disclosed herein may be employed, without departing from the scope of this disclosure. In some embodiments, the roofing membrane comprises a polymer. In some embodiments, the polymer comprises at least one of a polysiloxane, a silyl-terminated polymer, or any combination thereof. In some embodiments, the roofing membrane comprises 1% to 50% by weight of a magnetic-responsive additive based on a total weight of the roofing membrane. In some embodiments, a sufficient amount of the magnetic-responsive additive is magnetically aligned in a horizontal orientation, such that the roofing membrane has a reflectivity that is at least two times greater than a reflectivity of a roofing membrane which does not comprise the magnetic-responsive additive. In some embodiments, the roofing membrane is a cured roofing membrane.

Figure 2:
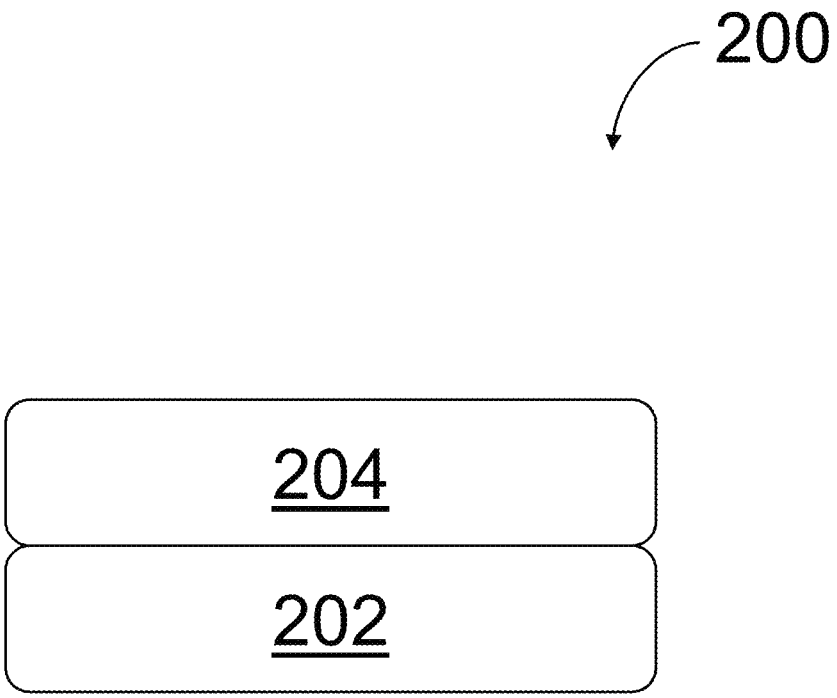
FIG. 2 is a schematic diagram of a cross-section of a roofing system, according to some embodiments.

FIG. 2 is a schematic diagram of a cross-section of a roofing system 200, according to some embodiments. As shown in FIG. 2, the roofing system 200 comprises a roofing substrate 202, and a cured composition 204 located on the roofing substrate 202.

Example 1

To illustrate the change in reflectivity, a roofing membrane was prepared and compared to a control roofing membrane. The formulations for the roofing membrane and the control roofing membrane were the same. That is, each of the roofing membranes were prepared with 90% by weight of a hydroxyl-terminated polysiloxane, 5% by weight of a graphene, 5% by weight of a crosslinker, and 0.1% by weight of a catalyst, where all percentages by weight are based on a total weight of the roofing membrane. The formulations for each of the roofing membranes were applied to a roofing substrate. The control roofing membrane was not exposed to a directional magnetic field, whereas the roofing membrane was exposed to a directional magnetic field using an array of magnetics configured to illustrate different regions of horizontally and vertically aligned graphene.

Figure 3:
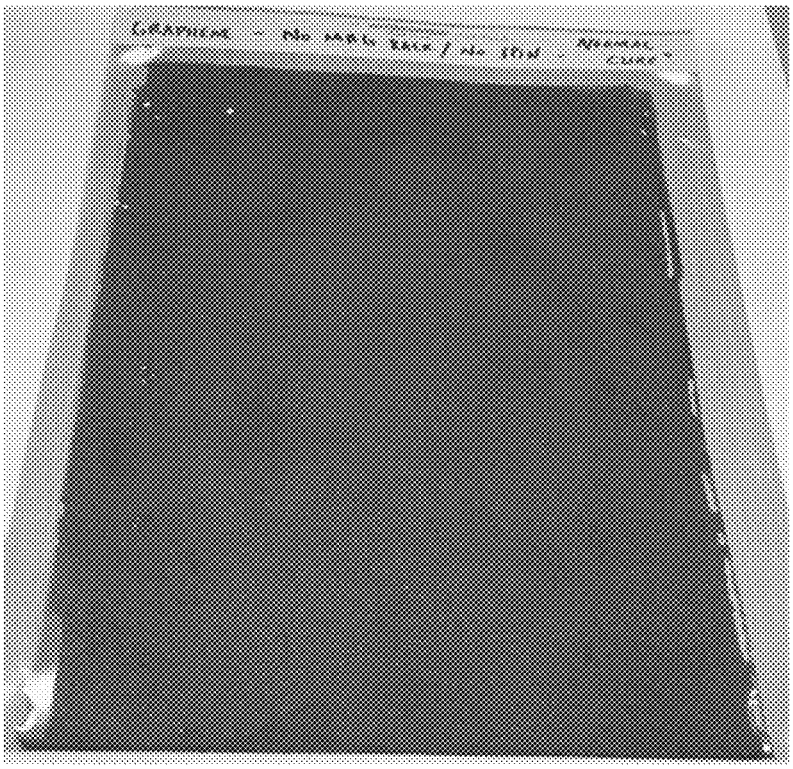
FIG. 3 is a photograph of a control roofing material, according to some embodiments.
Figure 4:
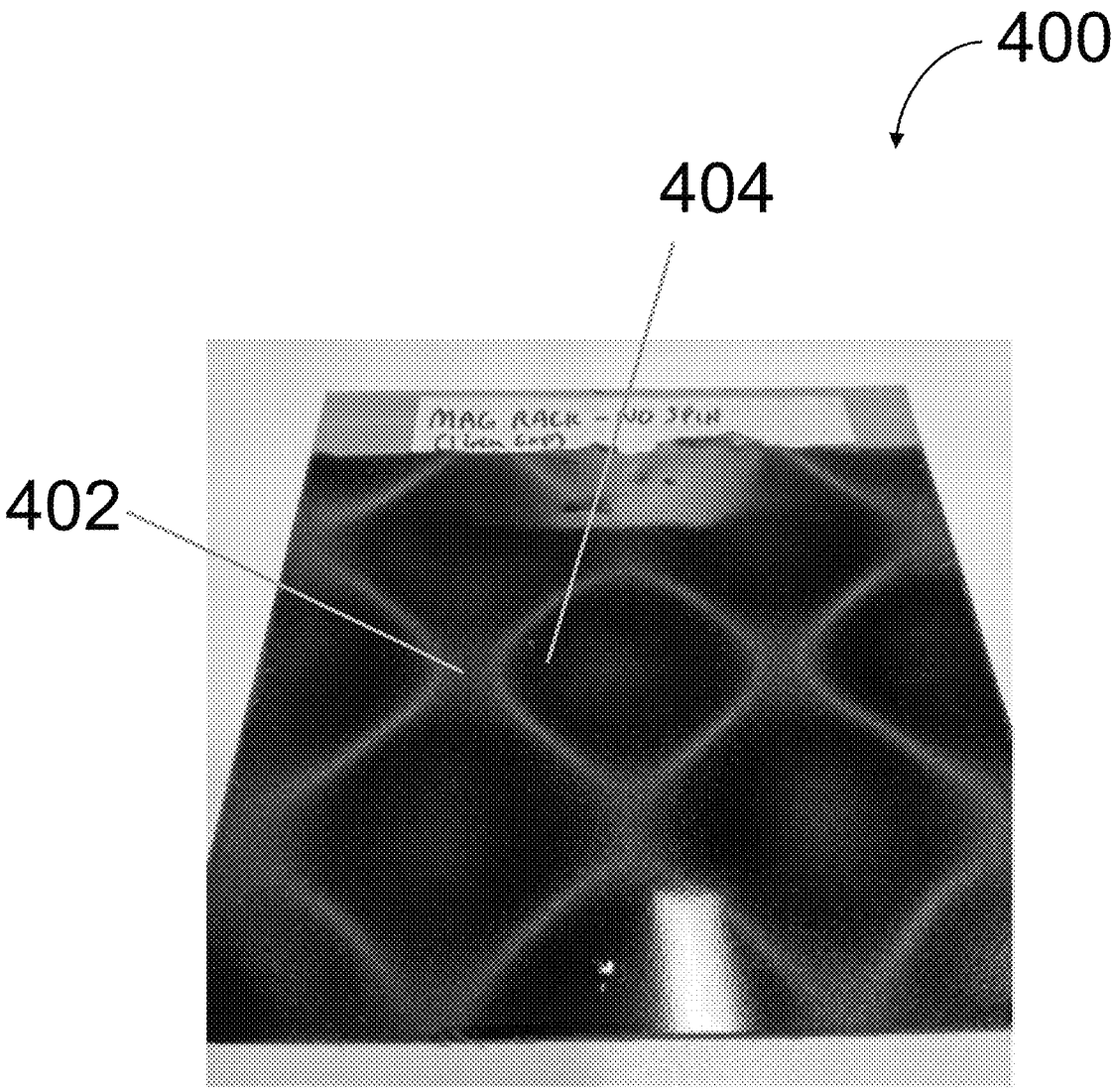
FIG. 4 is a photograph of a roofing material illustrating regions of horizontally aligned graphene and vertically aligned graphene, according to some embodiments.
Figure 5:
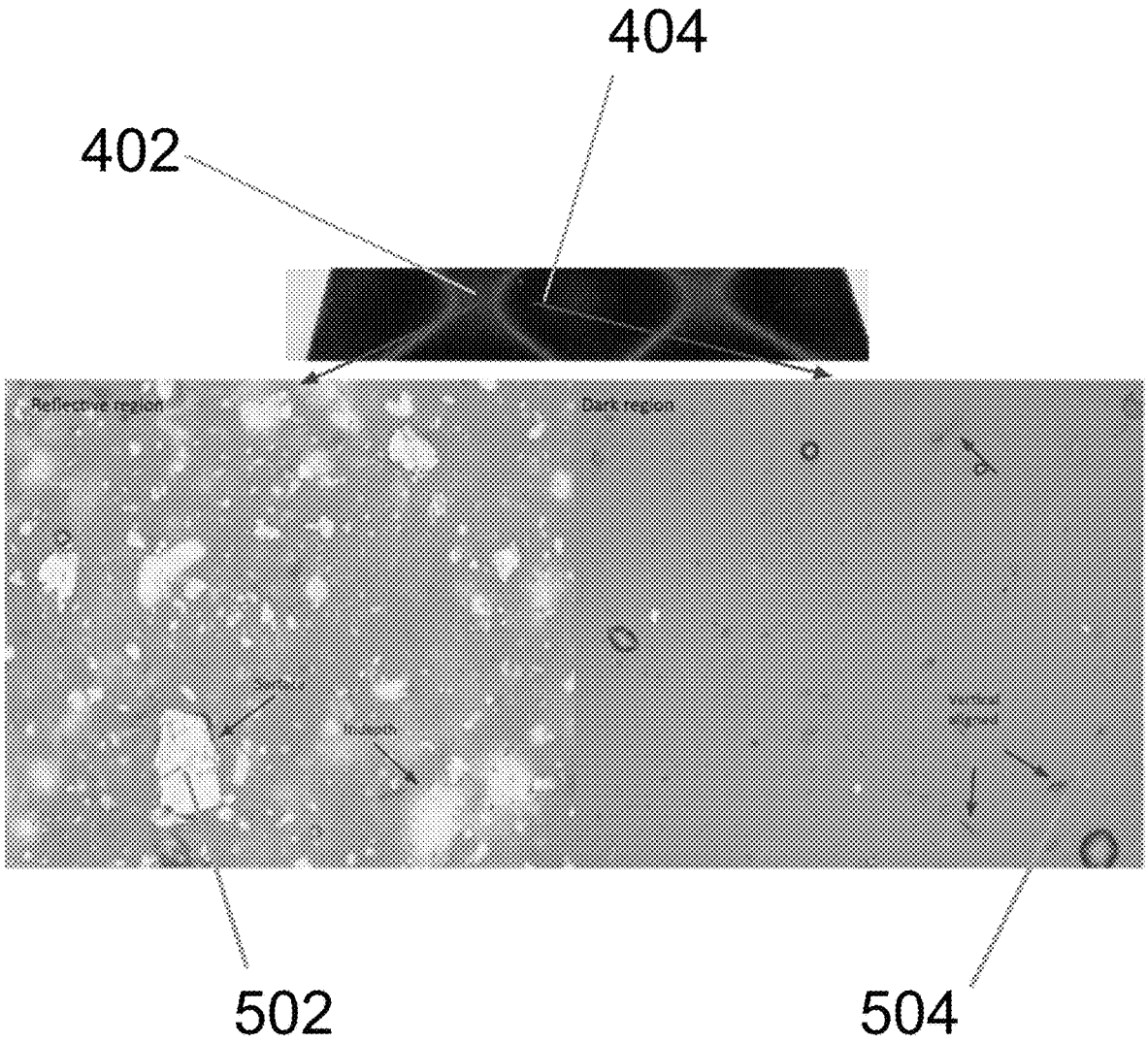
FIG. 5 is an optical microscopic image of a cross-section of the roofing material shown in FIG. 4, according to some embodiments.

FIG. 3 is a photograph of a control roofing material 300, according to some embodiments. The control roofing material 300 was not exposed to the directional magnetic field and thus no change in reflectivity was observed. FIG. 4 is a photograph of a roofing material 400 illustrating regions of horizontally aligned graphene and vertically aligned graphene, according to some embodiments. The roofing material 400 was exposed to the directional magnetic field and includes regions, such as region 404, in which the graphene is aligned in a vertical direction (e.g., darker regions) and regions, such as region 402, in which the graphene is aligned in a horizontal direction (e.g., lighter regions). FIG. 5 is an optical microscopic image of a cross-section of the roofing material 400, according to some embodiments. The graphene 502 is oriented in a horizontal direction, whereas the graphene 504 is oriented in a vertical direction. As shown in FIG. 5, the graphene 502 oriented in the horizontal direction increased a reflectivity of the roofing material 400 and had a lighter (or whiter) appearance; whereas the graphene 504 oriented in the vertical direction had a darker appearance.

Example 2

Figure 6:
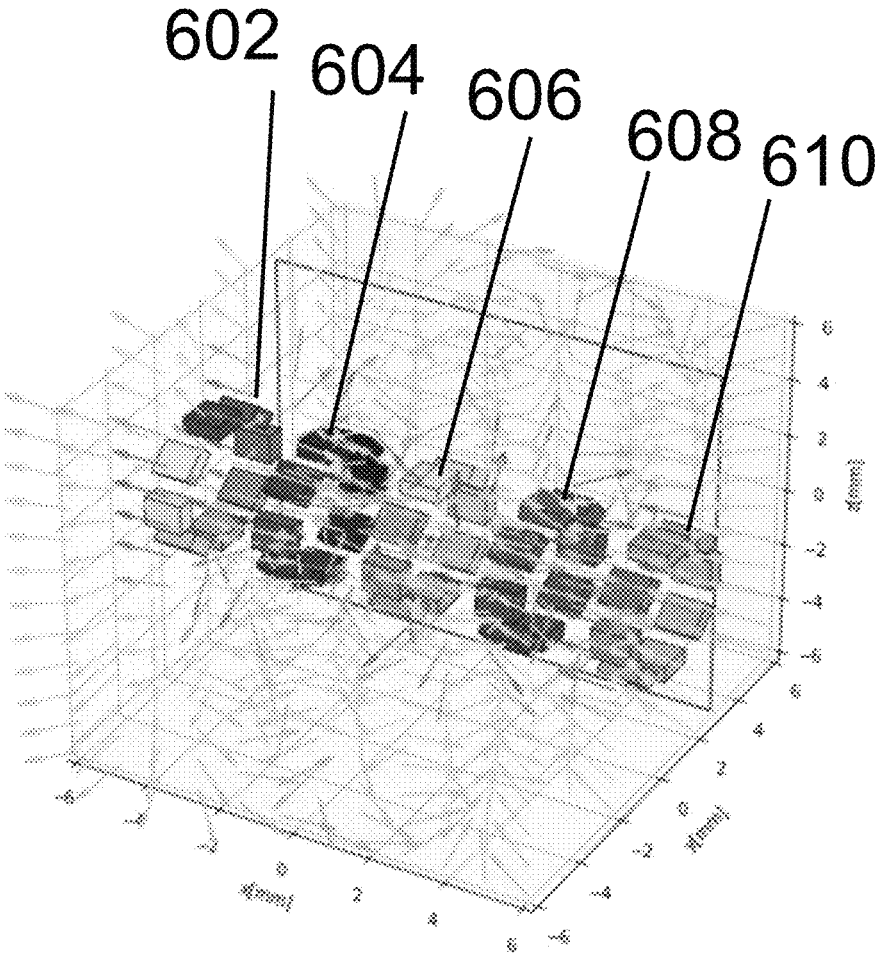
FIG. 6 is a schematic diagram depicting a plurality of circular Halbach arrays for a roller device, according to some embodiments.

A roller device comprises a hollow cylindrical roller. A plurality of circular Halbach arrays is installed on an inner surface of the hollow cylindrical roller. FIG. 6 is a schematic diagram depicting a configuration of a plurality of circular Halbach arrays for a roller device (e.g., within a hollow cylindrical roller), according to some embodiments. As shown in FIG. 6, the arrangement of the plurality of circular Halbach arrays comprises five circular Halbach arrays 602, 604, 606, 608, and 610. In some embodiments, the magnetic field is directional, wherein the direction of the magnetic field is outwards from a central axis, wherein the central axis is an axis along which the plurality of circular Halbach arrays is arranged, as shown.

What is claimed is:

1. A method of installation comprising:
obtaining a composition,
wherein the composition comprises:
a polymer,
wherein the polymer comprises at least one of a polysiloxane, a silyl-terminated polymer, or any combination thereof; and
1% to 50% by weight of a magnetic-responsive additive based on a total weight of the composition;
obtaining a roller device,
wherein the roller device comprises a roller;
wherein the roller contains a magnetic array,
wherein the magnetic array is configured to apply a directional magnetic field;
contacting the roller of the roller device with the composition, so as to:
spread the composition onto at least a portion of a surface of a roofing substrate; and
magnetically align at least a portion of the magnetic-responsive additive in a horizontal orientation; and
curing the composition, so as to obtain a cured roofing membrane.

2. The method of claim 1, further comprising, before the contacting step, applying the composition to the roller of the roller device.

3. The method of claim 1, further comprising, before the contacting step, applying the composition to the surface of the roofing substrate.

4. The method of claim 1, wherein curing comprises at least one of moisture-curing, heat curing, or any combination thereof.

5. The method of claim 1, wherein the composition comprises:
90% to 99% by weight of the polymer based on the total weight of the composition; and
1% to 10% by weight of the magnetic-responsive additive based on the total weight of the composition.

6. The method of claim 1, wherein the composition comprises:
95% to 99% by weight of the polymer based on the total weight of the composition; and
1% to 5% by weight of the magnetic-responsive additive based on the total weight of the composition.

7. The method of claim 1, wherein the magnetic-responsive additive is magnetically aligned in the horizontal orientation while the composition is spread onto at least a portion of the surface of the roofing substrate.

8. The method of claim 1, wherein the magnetic-responsive additive comprises at least one of graphene, carbon nanotubes, graphene oxide, metal dichalcogenides, graphite, or any combination thereof.

9. The method of claim 1, wherein the magnetic-responsive additive has a form of at least one of flakes, platelets, sheets, tubes, ribbons, rods, tubes, whiskers, fibers, spheres, cubes, or any combination thereof.

10. The method of claim 1, wherein a sufficient amount of the magnetic-responsive additive is magnetically aligned, by the magnetic array, in the horizontal orientation, so as to result in a cured roofing membrane having a reflectivity that is at least two times greater than a reflectivity of a cured control roofing membrane which does not comprise the magnetic-responsive additive.

* * * * *